US010810824B2

(12) United States Patent
Danielson et al.

(10) Patent No.: US 10,810,824 B2
(45) Date of Patent: Oct. 20, 2020

(54) ELECTRONIC GAMING MACHINE HAVING MULTI-SIDED DISPLAY AND INPUT DEVICE

(71) Applicant: IGT, Las Vegas, NV (US)

(72) Inventors: Patrick Danielson, Las Vegas, NV (US); Dwayne Nelson, Las Vegas, NV (US)

(73) Assignee: IGT, Las Vegas, NV (US)

( * ) Notice: Subject to any disclaimer, the term of this patent is extended or adjusted under 35 U.S.C. 154(b) by 44 days.

(21) Appl. No.: 16/156,290

(22) Filed: Oct. 10, 2018

(65) Prior Publication Data

US 2020/0118379 A1 Apr. 16, 2020

(51) Int. Cl.
*A63F 9/24* (2006.01)
*G07F 17/32* (2006.01)

(52) U.S. Cl.
CPC ..... *G07F 17/3211* (2013.01); *G07F 17/3209* (2013.01); *G07F 17/3272* (2013.01)

(58) Field of Classification Search
CPC ..... G07F 17/3211; G07F 17/3209; G07F 17/3272
See application file for complete search history.

(56) References Cited

U.S. PATENT DOCUMENTS 6,082,734 A 7/2000 Uehara et al.
6,450,884 B1 9/2002 Seelig et al.
6,715,756 B2 4/2004 Inoue
7,582,011 B2 9/2009 Maling
7,708,640 B2 5/2010 Burak et al.
7,806,760 B2 10/2010 Baerlocher
7,922,573 B2 4/2011 Baerlocher et al.
8,057,308 B2 11/2011 Kaminkow et al.
8,298,066 B2 10/2012 Kelly et al.
8,668,573 B1 3/2014 Mayeroff
9,524,615 B2 12/2016 Daeges et al.
2003/0148804 A1 8/2003 Ikeya et al.
2004/0192430 A1* 9/2004 Burak ..... G03H 1/2294 463/20
2004/0214630 A1* 10/2004 Mayeroff ..... G07F 17/3211 463/20
2005/0037843 A1* 2/2005 Wells ..... G07F 17/3211 463/30
2005/0075167 A1* 4/2005 Beaulieu ..... G07F 17/3211 463/32

(Continued)

OTHER PUBLICATIONS

Game Time International Expo Focus Brochure, published Aug. 2004 (1 page).

(Continued)

*Primary Examiner* — Steve Rowland
(74) *Attorney, Agent, or Firm* — Neal, Gerber & Eisenberg LLP

(57) ABSTRACT

Various embodiments provide a gaming system including one or more electronic gaming machines having a shareable multi-sided display and input device. In various embodiments, the multi-sided display and input device has a spherical or substantially spherical outer surface and is configured to enable one or a plurality of players to play one or more games. In various other embodiments, the gaming system includes multiple electronic gaming machines and the shareable multi-sided display and input device.

17 Claims, 13 Drawing Sheets

(56) References Cited

U.S. PATENT DOCUMENTS

| | | | | |
|---|---|---|---|---|
| 2005/0233794 | A1* | 10/2005 | Cannon | G07F 17/32 463/16 |
| 2007/0117603 | A1* | 5/2007 | Seelig | G07F 17/3211 463/16 |
| 2007/0149281 | A1 | 6/2007 | Gadda et al. | |
| 2009/0104964 | A1* | 4/2009 | Snow | G07F 17/32 463/20 |
| 2010/0210347 | A1* | 8/2010 | Seelig | G07F 17/3211 463/20 |
| 2011/0287824 | A1* | 11/2011 | Schultz | G07F 17/3223 463/20 |
| 2011/0306402 | A1* | 12/2011 | Van Linden | G07F 17/3213 463/20 |
| 2013/0310134 | A1* | 11/2013 | Daeges | A63F 13/005 463/20 |
| 2014/0364217 | A1* | 12/2014 | Parra | G07F 17/3209 463/31 |
| 2016/0005263 | A1* | 1/2016 | Keilwert | H04N 13/282 463/33 |

OTHER PUBLICATIONS

Global Imagination®—Magic Planet Projection Globe, www.globalimagination.com, available prior to Oct. 10, 2018 (2 pages).
Picture of gaming system with dome, available prior to Oct. 10, 2018 (1 page).
Picture of A.C. Coin Super Bankroll Bonus multi-sided gaming system, available prior to Oct. 10, 2018 (1 page).

* cited by examiner

ELECTRONIC GAMING MACHINE HAVING MULTI-SIDED DISPLAY AND INPUT DEVICE

BACKGROUND

The present disclosure relates to gaming systems, and more particularly to electronic gaming machines that enable play of wagering games. Electronic gaming machines may include one or more primary wagering games. Electronic gaming machines may also include one or more secondary games. Electronic gaming machines may include one or more display devices that display plays of the primary wagering games and the secondary games. Electronic gaming machines may include one or more input devices that enable player inputs associated with plays of the primary wagering games and the secondary games.

BRIEF SUMMARY

Various embodiments of the present disclosure provide a gaming system including an electronic gaming machine having a shareable multi-sided display and input device. In various such embodiments, the shareable multi-sided display and input device has a spherical or substantially spherical outer surface and is configured to enable one or a plurality of players to play one or more games.

Various other embodiments of the present disclosure provide a gaming system having multiple electronic gaming machines with a shareable multi-sided display and input device that is configured to enable one or a plurality of players to play one or more games. In various such embodiments, the shareable multi-sided display and input device has a spherical or substantially spherical outer surface and is configured to enable one or a plurality of players to play one or more games.

Various other embodiments of the present disclosure provide a gaming system having multiple electronic gaming machines with a sharable multi-sided display device that is configured to display one or more plays of one or more games to one or more players. In various such embodiments, the multi-sided display device has a spherical or substantially spherical outer surface and is configured to display one or more plays of one or more games to one or more players.

Various other embodiments of the present disclosure provide an electronic gaming machine including: a housing; a substantially spherical display and input device supported by the housing; a processor; and a memory device that stores a plurality of instructions, which when executed by the processor, cause the processor to: receive, via the substantially spherical display and input device, an input from each of a plurality of players, and for each of the plurality of players, allocate a portion of the substantially spherical display and input device to display game play to the player, wherein a size of each portion is based on a quantity of the players.

Various other embodiments of the present disclosure provide an electronic gaming machine including: a housing; a substantially spherical display and input device supported by the housing; a processor; and a memory device that stores a plurality of instructions, which when executed by the processor, cause the processor to: receive, via the substantially spherical display and input device, an input from each of a plurality of players, for each of the plurality of players, allocate a portion of the substantially spherical display and input device to display game play to the player, and allocate a portion of the substantially spherical display and input device for displaying images other than for the game play by the players.

Various other embodiments of the present disclosure provide a gaming system including: a substantially spherical display device; and a plurality of electronic gaming machines that share the substantially spherical display device; the electronic gaming machines and the substantially spherical display device configured to: for each of the plurality of electronic gaming machines, allocate a portion of the substantially spherical display device to display game play to a player of the that electronic gaming machine, wherein a size of each portion is based on a quantity of the electronic gaming machines being played.

Additional features are described in, and will be apparent from, the following Detailed Description and the Figures.

DETAILED DESCRIPTION

Figure 1:
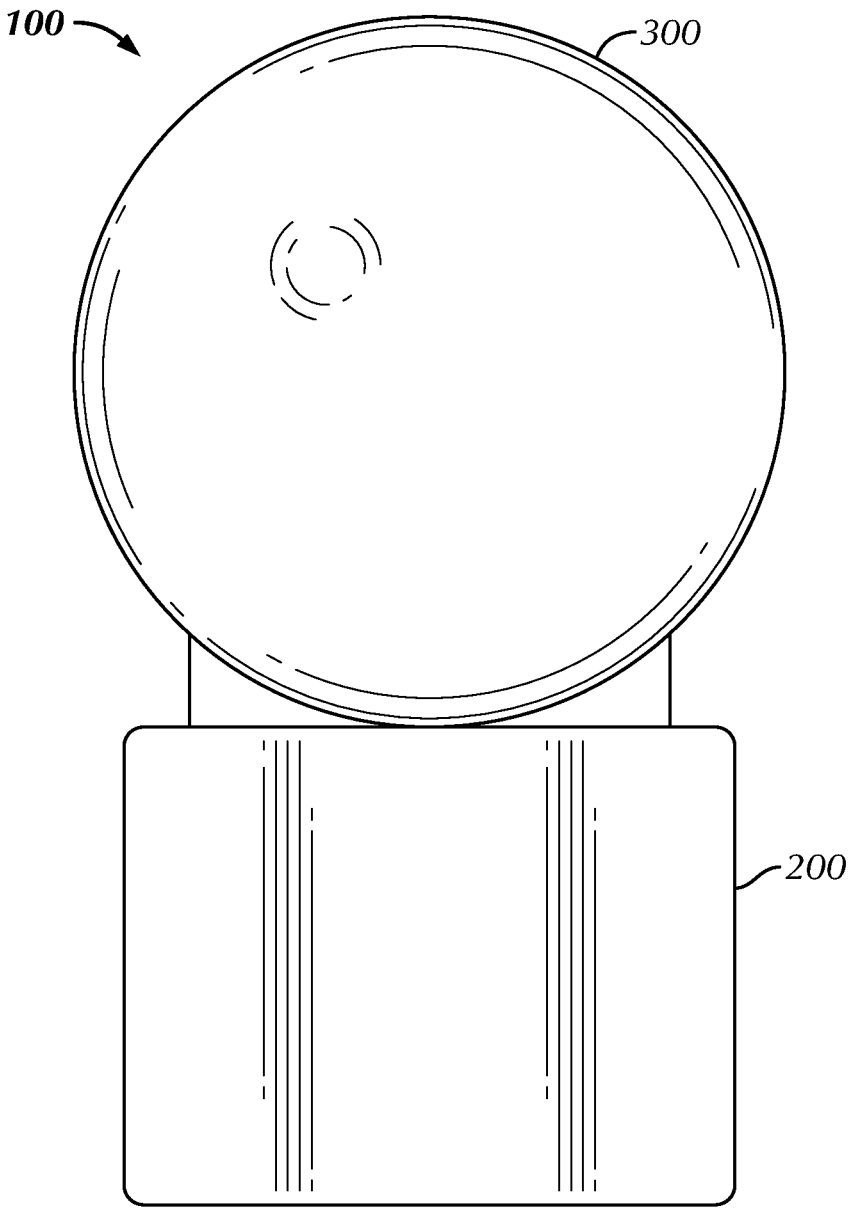
FIG. 1 is a front view of an electronic gaming machine having a housing and a shareable multi-sided display and input device of one example embodiment of the present disclosure.

Various embodiments of the present disclosure provide new gaming systems including one or more electronic gaming machines ("EGMs") having a housing and a shareable multi-sided display and input device mounted on and supported by the housing. In various such embodiments, the shareable multi-sided display and input device has a spherical or substantially spherical outer surface. In various such embodiments, the outer surface of the shareable multi-sided display and input device is spherical except for a bottom portion thereof that is attached to the housing (and that is thus considered substantially spherical for purposes of this disclosure). In various such embodiments, the shareable multi-sided display and input device provides a 360 degree display for primary and secondary game play, game play related images, and other suitable images. Thus, in various such embodiments, the shareable multi-sided display and input device is configured to display images in directions extending 360 degrees around the shareable multi-sided display and input device. In various such embodiments, the shareable multi-sided display and input device is also configured to receive inputs from directions extending 360 degrees around the display device.

For brevity and clarity, and unless specifically stated otherwise, the term "EGM" is used herein to refer to an electronic gaming machine (such as but not limited to a slot machine, a video poker machine, a video card machine, a video lottery terminal (VLT), a video keno machine, a video bingo machine, a sports betting terminal, or an electronic gaming table).

For brevity and clarity, and unless specifically stated otherwise, the term "360 degree device" is used herein to refer to the shareable multi-sided display and input device of the present disclosure or to the shareable multi-sided display device of the present disclosure, as applicable.

In various example embodiments described below, the 360 degree device is configured to be part of a single EGM.

In various other example embodiments described below, the 360 degree device is configured to be part of a gaming system that includes multiple EGMs (such as but not limited to two, three, or four EGMs) that share the 360 degree device.

In various other example embodiments described below, the 360 degree device is configured to be part of a gaming system that includes multiple EGMs (such as but not limited to two, three, or four EGMs) that share the 360 degree device, and that receive player inputs for play at the EGMs, and wherein the 360 degree device is not configured to receive player inputs.

Thus, various embodiments of the present disclosure provide a gaming system including an EGM having a shareable multi-sided display and input device, and wherein the multi-sided display and input device has a spherical or substantially spherical outer surface and is configured to enable one or a plurality of players to play one or more games.

Additionally, various other embodiments of the present disclosure provide a gaming system having multiple EGMs with a shareable multi-sided display and input device that is configured to enable one or a plurality of players to play one or more games, and wherein the multi-sided display and input device has a spherical or substantially spherical outer surface and is configured to enable one or a plurality of players to play one or more games.

Additionally, various other embodiments of the present disclosure provide a gaming system having multiple EGMs that share the multi-sided display device that is configured to display one or more plays of one or more games to one or more players, and wherein the multi-sided display device has a spherical or substantially spherical outer surface and is configured to display one or more plays of one or more games to one or more players (but is not configured to receive player inputs).

In various embodiments, the gaming system, for each of the plurality of players, allocates a separate distinct portion of the 360 degree device to display game play to the player, wherein a size of each respective portion is based on a quantity of the players. In various embodiments, the gaming system, and particularly the 360 degree device display one or more partitions that indicate each of the allocated separate distinct player portions of the 360 degree display device for each of the plurality of player. In various other embodiments, the gaming system, and particularly the 360 degree device do not display any partitions that indicate each of the allocated separate distinct player portions of the 360 degree display device for each of the plurality of player. In certain such other embodiments, the allocated portions are otherwise indicated (such as with fading or other methods).

In various embodiments, when an additional player makes an input to join game play, the gaming system reallocates one or more of the portions of 360 degree display.

In various embodiments, the gaming system uses the 360 degree display device to provide two or more players a shared game. In various embodiments, the gaming system uses the 360 degree display device to provide two or more players separate games. In various embodiments, the gaming system uses the 360 degree display device to provide two or more players a shared game and simultaneously provide separate games.

In various embodiments, the gaming system uses the 360 degree display device to enable one or more players to make one or more inputs using the respective player mobile device.

Various embodiments of the present disclosure also provide new methods of operating such new gaming systems and new EGMs.

First Example Gaming System

Referring now to FIGS. 1 to 10, one example gaming system of the present disclosure is generally illustrated. This example gaming system includes an EGM 100 having: (1) a housing 200 (that may sometimes be referred to herein as a "base" or a "cabinet"); and (2) a 360 degree device 300 suitably mounted on, suitably connected to, and suitably supported by the housing 200.

The illustrated example 360 degree device 300 enables each of one or more players (such as example players 1, 2, 3, and 4 shown in FIGS. 4, 5, 6, 7, 8, and 9) to operate the EGM 100 while standing adjacent to the EGM 100. In various such embodiments, multiple players can stand around the EGM 100 as generally shown in FIGS. 4, 5, 6, 7, 8, and 9. In other embodiments, one or more players can sit on suitable chairs or stools (such as high top chairs or stools (not shown) or an adjustable height chairs or stools (not shown)) to play the EGM 100.

In this illustrated example embodiment, the 360 degree device 300 is configured to (depending on the quantity of players at the EGM 100): (1) receive player inputs from one player at the EGM 100; (2) display plays of primary games (including the game features, game outcomes, game awards, game information, and/or other game functionality and information) to one player at the EGM 100; (3) display plays of secondary games (including the game features, game outcomes, game awards, game information, and/or other game functionality and information) to one player at the EGM 100; (4) receive player inputs from two or more players at the EGM 100 (such as two, three, or four players at the EGM 100); (5) display plays of primary games (including the game features, game outcomes, game awards, game information, and/or other game functionality and information) to two or more players at the EGM 100 (such as two, three, or four players at the EGM 100); (6) display plays of secondary games (including the game features, game outcomes, game awards, game information, and/or other game functionality and information) to two or more players at the EGM 100 (such as two, three, or four players at the EGM 100); (7) display one or more live, delayed, or previously recorded videos such as but not limited to sporting events; (8) display one or more player service windows that show various desired player information or activity; (9) display information (such as event information) and/or advertisements; and/or (10) display awards such as but not limited to progressive awards.

In various embodiments, the 360 degree device 300 is configured to enable multiple players (such as two, three, or four players) to simultaneously play: (1) one or more individual primary games; (2) one or more individual secondary games; (3) one or more individual skill based games; (4) one or more shared or community primary games; (5) one or more shared or community secondary games; (6) one or more individual skill based games; (7) one or more shared or community skill based games; and/or (8) one or more competitive or player versus player games.

In various embodiments, the portions of the 360 degree device 300 that are allocated to each player are at least partially based on the total quantity of players that are playing the EGM 100, and in certain embodiments, the maximum quantity of players that the 360 degree device 300 is configured to enable to play the EGM 100.

For example, in various embodiments, if a single player is playing the EGM 100, the EGM 100 can allocate a first portion of the 360 degree device 300 to the player (such as a 180 degree portion of the 360 degree device 300 and up to a 360 degree portion of the 360 degree device 300). In such embodiments, where only a single player is playing the EGM 100, the EGM can use a portion of or the entire 360 degree device to display game play to the single player. These embodiments enable the single player at the EGM 100 to play on a relatively wide and highly visible portion of the 360 degree device 300.

In various embodiments, where only a single player is playing the EGM 100, the EGM 100 can direct, instruct, or otherwise cause the player to move around the 360 degree device 300 to see the parts of the game play or other displayed information or images. For example, the EGM 100 can direct, instruct, or otherwise cause the player to move around the 360 degree device 300 to second side to make changes to displayed gears to modify a mechanical-related display displayed on a first side of 360 degree device 300 display.

In various embodiments, the EGM 100 can provide image movement controls (such as rotational controls) to enable the player to move (such as rotate) the displayed images (such as to follow a character, item or object). These controls can be displayed by the 360 degree device 300 or otherwise provided by the EGM 100, or a mobile device in communication with the EGM 100.

Figure 2:
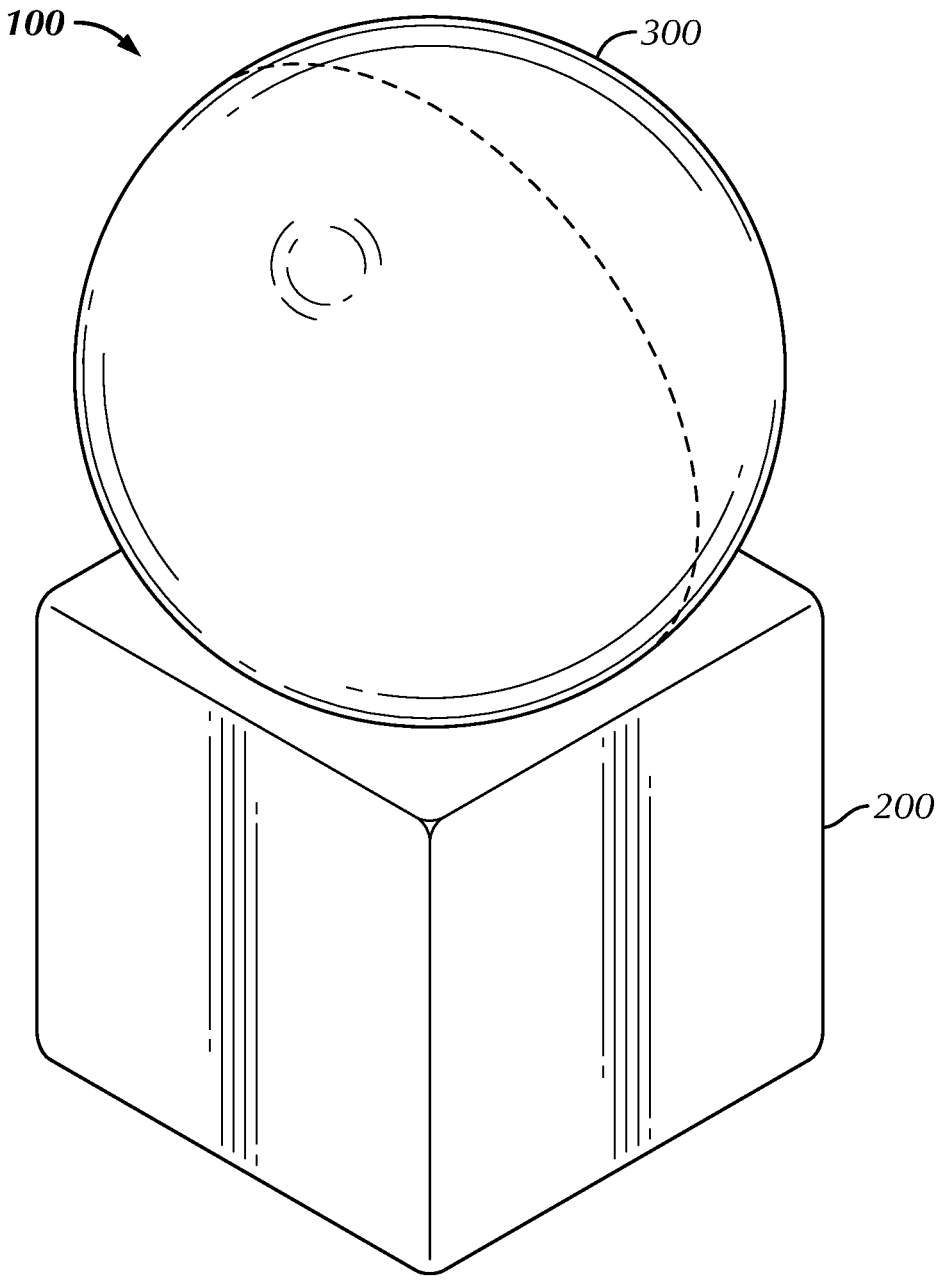
FIG. 2 is a top perspective view of the electronic gaming machine having the housing and the shareable multi-sided display and input device of FIG. 1.
Figure 4:
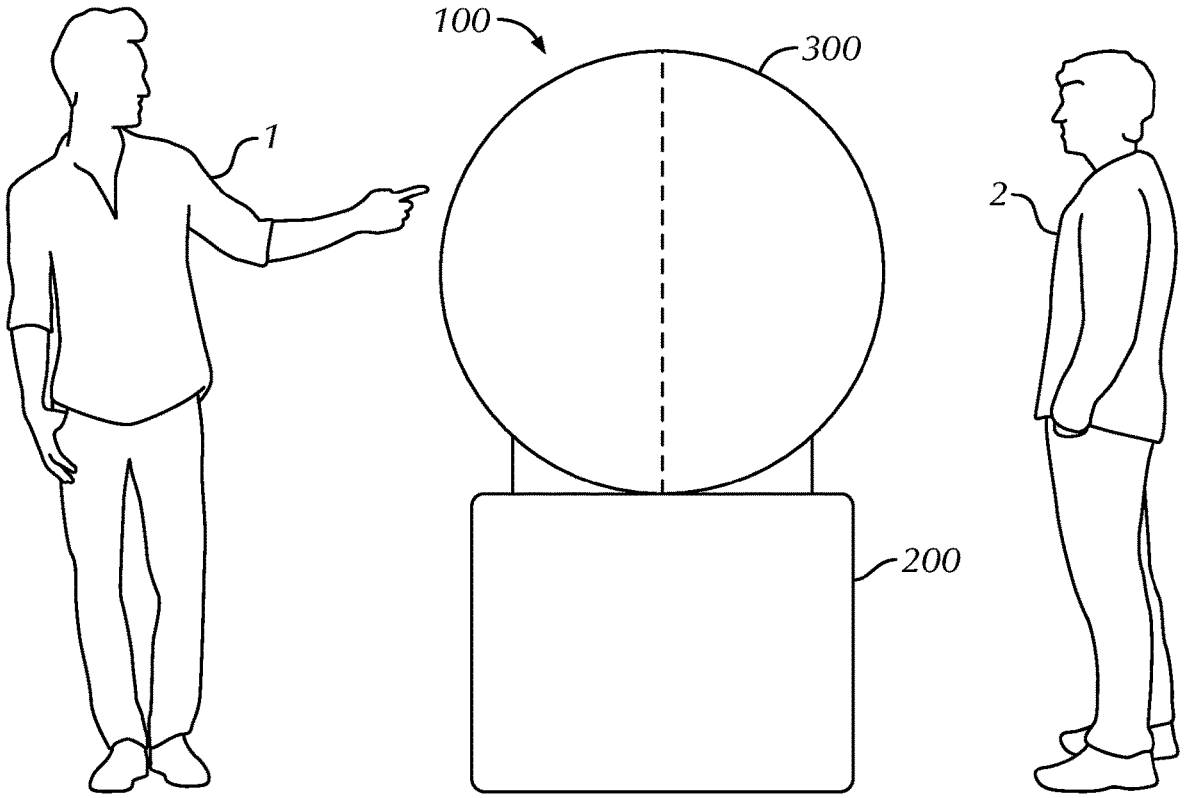
FIG. 4 is a side view of the electronic gaming machine having the housing and the shareable multi-sided display and input device of FIG. 1, and showing two players positioned at respective player positions next to the electronic gaming machine.

In various embodiments, if two players are playing the EGM 100, the EGM 100 can allocate first and second portions of the 360 degree device 300 to the respective first and second players (such as allocating respective 180 degree portions of the 360 degree device 300 to each of the first and second players as generally shown by the phantom lines in FIGS. 2 and 4). In other embodiments, the allocations of the 360 degree device 300 to the two players do not have to be equal.

In various embodiments, if three players are playing the EGM 100, the EGM 100 can allocate first, second, and third portions of the 360 degree device 300 to the respective first, second, and third players (such as allocating respective 120 degree portions of the 360 degree device 300 to each of the first, second, and third players). In other embodiments, the allocations to the three players do not have to be equal (i.e., they can be unequal for at least two of these players).

Figure 3:
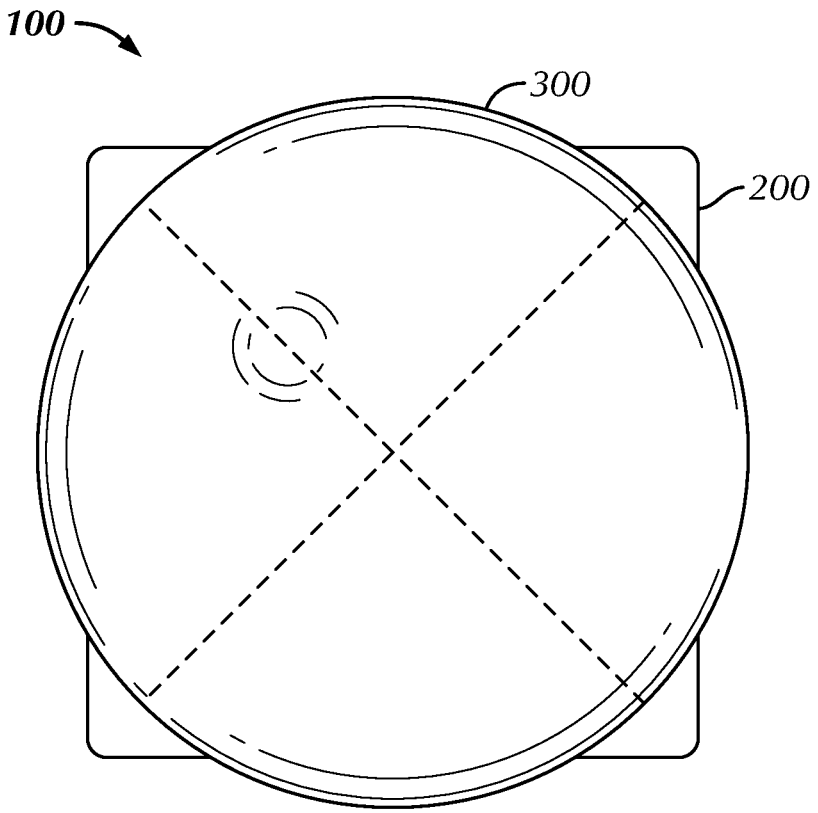
FIG. 3 is a top view of the electronic gaming machine having the housing and the shareable multi-sided display and input device of FIG. 1.
Figure 5:
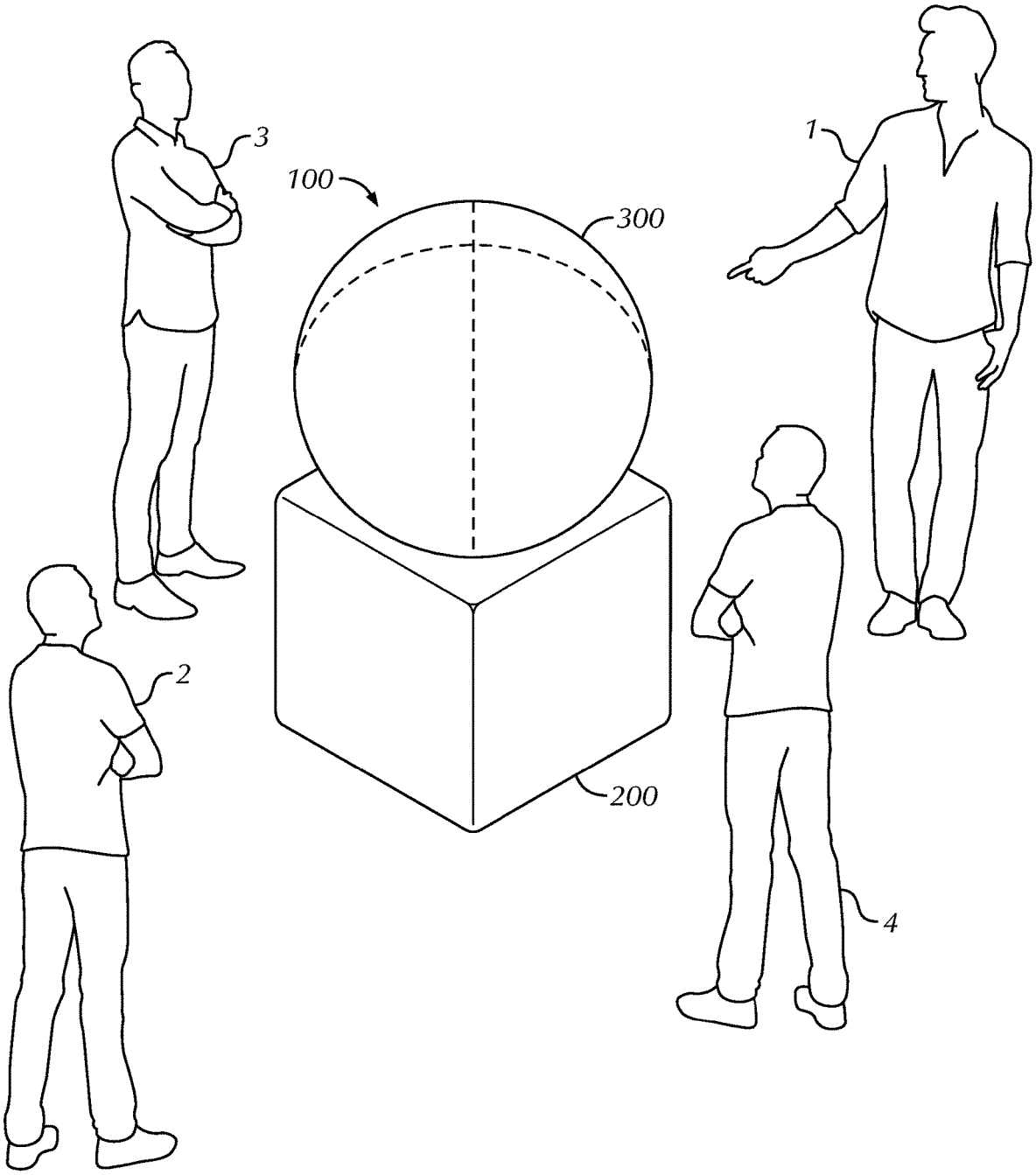
FIG. 5 is a top perspective view of the electronic gaming machine having the housing and the shareable multi-sided display and input device of FIG. 1, and showing four players positioned at respective player positions next to the electronic gaming machine.

In various embodiments, if four players are playing the EGM 100, the EGM 100 can allocate first, second, third, and fourth portions of the 360 degree device 300 to the respective first, second, third, and fourth players (such as allocating respective 90 degree portions of the 360 degree device 300 to each of the first, second, third, and fourth players as generally shown by the phantom lines in FIGS. 3 and 5). In other embodiments, the allocations to the four players do not have to be equal (i.e., they can be unequal for at least two of these players).

It should be appreciated that these embodiments enable different specific portion (or regions) of the 360 degree device to work as different player terminals at the same time or at different times.

In various embodiments, the allocations to each player of the portion of the 360 degree device 300 can be based on one or more factors such as but not limited to: (1) one or more random determinations; (2) one or more wagers made by the players (e.g., the larger the wager, the larger the portion of the 360 degree device 300); (3) the comparative wagering levels of the players; (4) the relative player tracking levels of the players; (5) which games the players are playing; (6) whether one of the players is playing a secondary game; (7) one or more winning events by the players; (8) one or more time durations such as length of time of play; (9) total amounts wagered by players over a period of time; (10) the denominations that are being wagered by players; (11) the types of games (such as a pure random determination game versus a skill based game that employs a greater amount of display area); (12) one or more inputs made by the players to control the relative portions; (13) one or more decisions made by player to play cooperatively or independently; (14) purchases by one or more of the player of greater portions of the 360 degree device 300 (using monetary credits, player points, and/or other forms of payment); (15) events or outcomes of the game play—such as small wins versus larger or more exciting wins; (16) one or more competitive events or games between the players to win greater portions of the 360 degree device 300; (17) relative speeds of play of the various players (including idle time between plays); (18) detecting one on more players in seats adjacent to the 360 degree device 300; and/or (19) the portions needed for one or more augmented reality devices employed with the 360 degree device 300.

In various such embodiments, if less than the maximum quantity of players are playing the EGM 100, the EGM 100 can allocate one or more portions of the 360 degree device 300 for one or more new players to join play at the 360 degree device 300. In various such embodiments, the allocation(s) for the new players can be relatively small compared to the portions for the active players at the 360 degree device 300. For example, if two players are playing at the 360 degree device 300, the EGM 100 can allocate 160 degree portions to each of these two player and two 20 degree portions to enable two new players to join gameplay at the EGM 100. When one or more new players join game player, the EGM 100 can then reallocate the respective portions for one, a plurality, or all of the players at the EGM 100.

Figure 6:
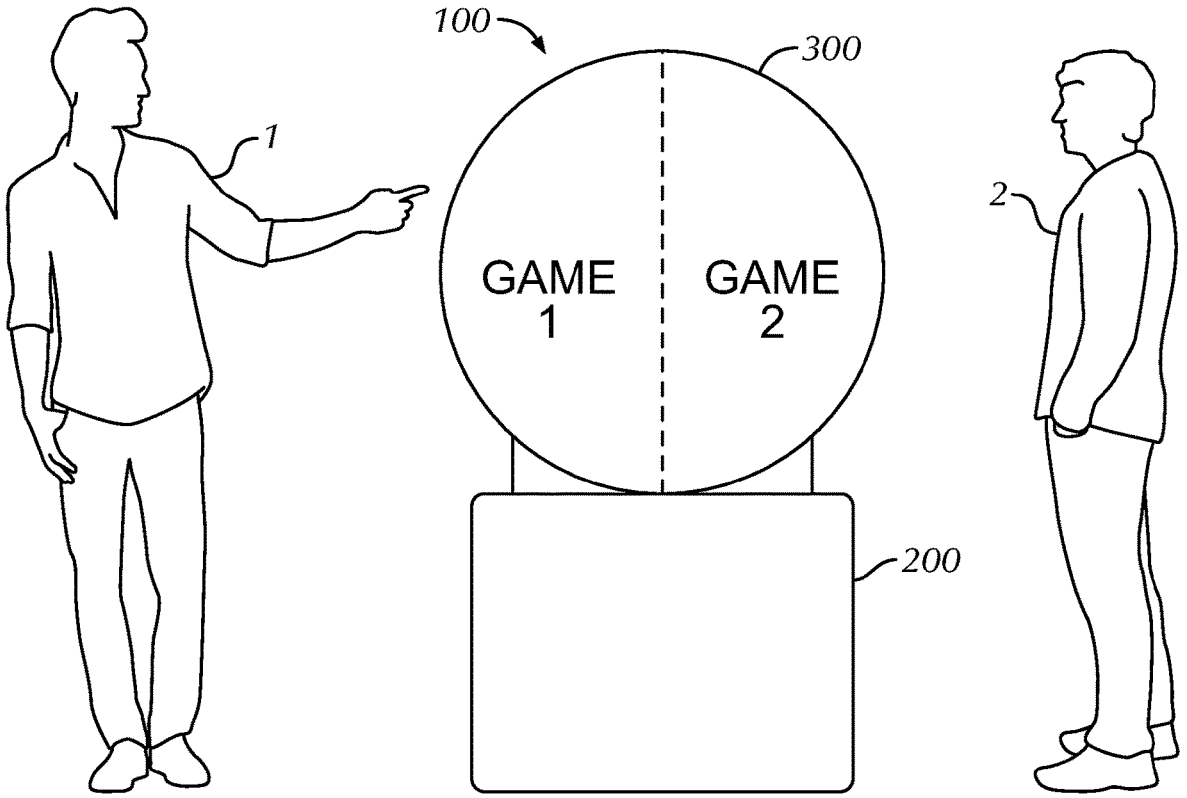
FIG. 6 is a side view of the electronic gaming machine having the housing and the shareable multi-sided display and input device of FIG. 1, and showing two players Positioned at respective player positions next to the electronic gaming machine playing two separate games.
Figure 7:
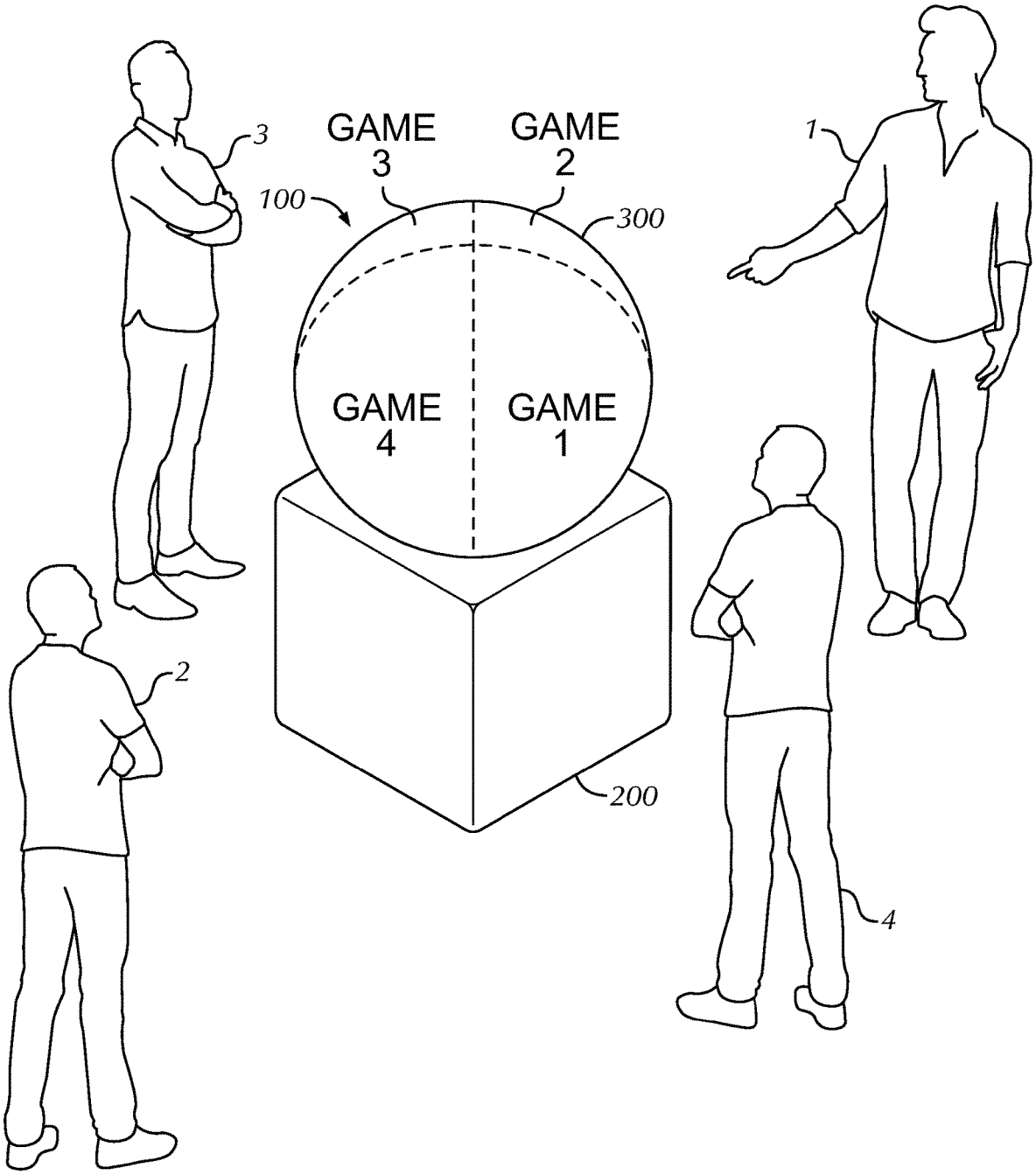
FIG. 7 is a top perspective view of the electronic gaming machine having the housing and the shareable multi-sided display and input device of FIG. 1, and showing four players positioned at respective player positions next to the electronic gaming machine playing four separate games.

In various embodiments, the 360 degree device 300 enables each of a plurality of players to play one or more separate wager games provided by the EGM 100 using the 360 degree device 300 such as shown in FIGS. 6 and 7. The games can be any suitable separate games.

Figure 8:
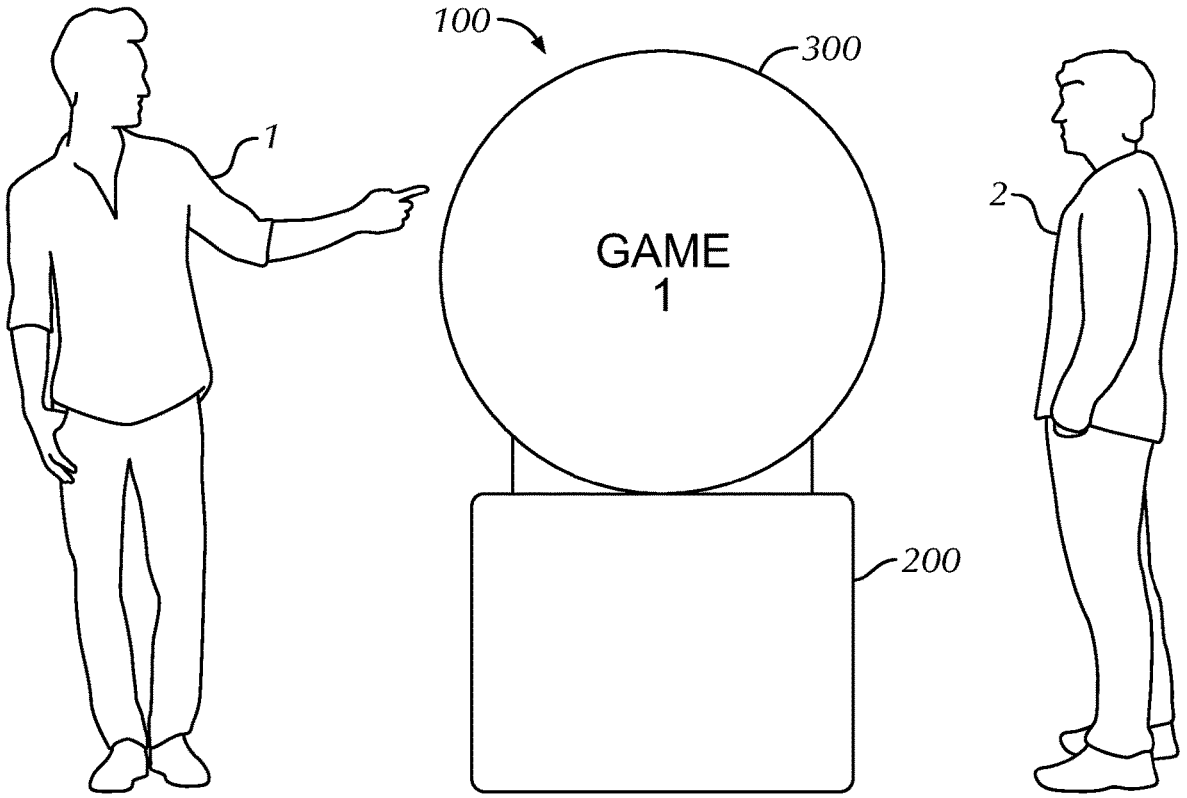
FIG. 8 is a side view of the electronic gaming machine having the housing and the shareable multi-sided display and input device of FIG. 1, and showing two players positioned at respective player positions next to the electronic gaming machine playing a same game.
Figure 9:
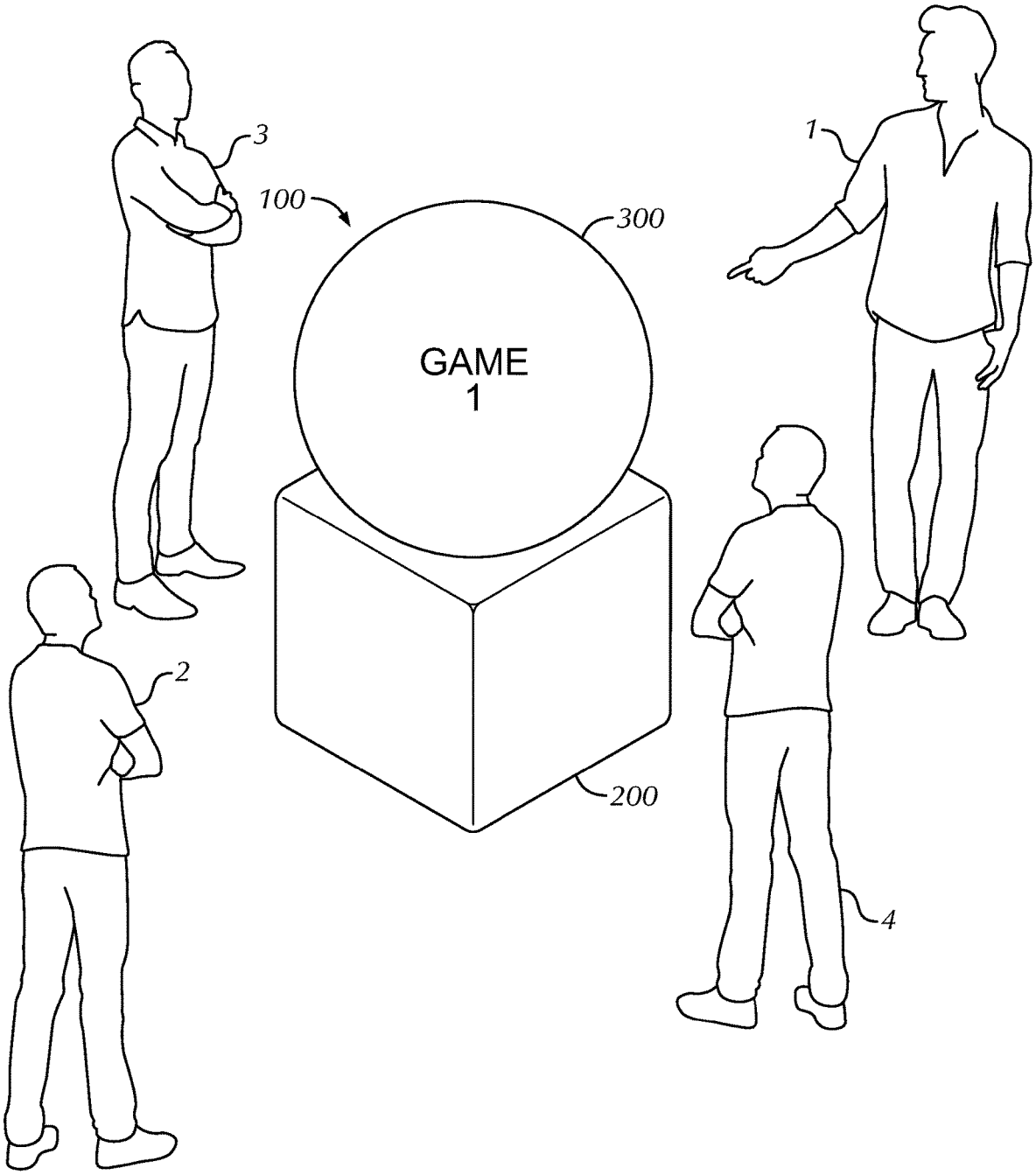
FIG. 9 is a top perspective view of the electronic gaming machine having the housing and the shareable multi-sided display and input device of FIG. 1, and showing four players positioned at respective player positions next to the electronic gaming machine playing a same game.

In various embodiments, the 360 degree device 300 enables each of a plurality of players to play a same or shared game provided by the EGM 100 using the 360 degree device 300 such as shown in FIGS. 8 and 9. The shared game can be any suitable same game. For example, in various embodiments, the EGM 100 and the 360 degree device 300 are configured to display horizontally rotatable reels (not shown) that rotate around the entire 360 degree device 300 (in one direction, in different directions, or in changing directions). In various such embodiments, the size, shape, or other configuration of the reels may be the same or different based on the spherical or substantially spherical shape of the 360 degree device.

In various embodiments, the 360 degree device 300 enables each of a plurality of players to play or enter into and play a communal primary game or a communal bonus game (which can be Game 1 as indicated in FIG. 8 where multiple players simultaneously play the same game using the 360 degree device 300).

One such example communal bonus game includes one or more 360 degree wheels (not shown) displayed by the 360 degree device 300.

Another such example communal game includes a planetary strategy game in which the 360 degree device 300 displays a globe and facilitates the game play on the displayed globe. This example employs the 360 degree characteristic of the 360 degree device 300.

Another such example includes video card games displayed by the 360 degree device 300 where one or more of the cards are shared by two or more of the players. Such examples can include video poker hands displayed by the 360 degree device 300.

Another example game includes a selection game displayed by the 360 degree device 300. For example, the 360 degree device 300 can be employed to facilitate play of a primary game in which each player can select and wager on one or more distinct areas displayed by the 360 degree device 300. The EGM 100 randomly selects a designated quantity of the areas, causes the 360 degree device 300 to display those selected areas, and provides any awards to the players for matches based on their selected areas. In various such embodiments, two or more of the areas can have different sizes, different shapes, different odds, and different awards. This can also be implemented as a secondary game.

Another example game includes a musical chairs type game. For example, the 360 degree device 300 can direct, instruct or otherwise cause the players to move around the 360 degree device 300 and: (1) sit on adjacent chairs at some point; or (2) stop next to designated slices of the 360 degree device 300. The 360 degree device 300 can be configured to detect the motions of the players and provide awards based on certain player movements.

Another example game includes a game having one or more game elements that are displayed by the 360 degree device 300 rotating around that device. The game elements can move pass one or more of the players. The 360 degree device 300 would enable each player to use each element only when the element is in reach or when they are in the portion of the 360 degree device 300 allocated to that player. For example, poker cards can be displayed moving around the 360 degree device 300 and players touch them as the card go by the players to build poker hands.

It should thus be appreciated that the 360 degree device 300 can provide multiple players with competitive or non-competitive gaming experiences.

In various other embodiments, the 360 degree device 300 enables each of a plurality of players to play or enter into and play a primary or secondary game where the players take turns at making inputs. The 360 degree device 300 can be especially configured to provide such games where parts of the displayed game or the entire displayed game is rotated on the 360 degree device 300 in sequence to enable each player to take their respective turn. In certain such embodiments, the displayed background is static. In certain such embodiments, the goal of the game is for the players to win awards by following around specific objects (such as characters).

In various other embodiments, as indicated above, the EGM 100 displays one or more sporting events on one or more portions of the 360 degree device 300. The sporting events can be part of a game, associated with a wager made by one of the players, or otherwise displayed. The sporting events can be live or can be delayed or recorded. For example, the 360 degree device 300 can display live horse racing and can facilitate wagering on such live horse racing.

In various embodiments, the 360 degree device 300 includes dedicated areas for displaying different team indicators (such as team logos), which when selected, function like or as PIP (Picture In Picture) type windows to display games being played by such teams or other team related information. In certain such embodiments, the 360 degree device 300 enables the player to adjust the size, shape, and/or positions of these areas relative to the game play areas.

In various embodiments, the EGM 100 displays one or more live table game events on one or more portions of the 360 degree device 300. The live table game events can be part of a game or otherwise displayed. The live table game events can be live or can be delayed or recorded.

In various embodiments, the EGM 100 displays one or more other events on one or more portions of the 360 degree device 300. For example, the 360 degree device 300 can be used to display any event involving a spherical object or partially spherical object such but not limited to: (1) a display associated with a count-down ball such as a new year's eve ball; (2) a display associated with a rotating planet such as the earth; or (3) a spherical fish tank. In other examples, the 360 degree display device 300 display: (1) a portal to another time and place; (2) a video feed from another EGM or electronic table; (3) a historical activity such as a play of a game from a prior day; (4) other interesting information such as a molecules or atoms; (5) indicates of previous winning player; or (6) camera arrays showing the reverse views.

Figure 10:
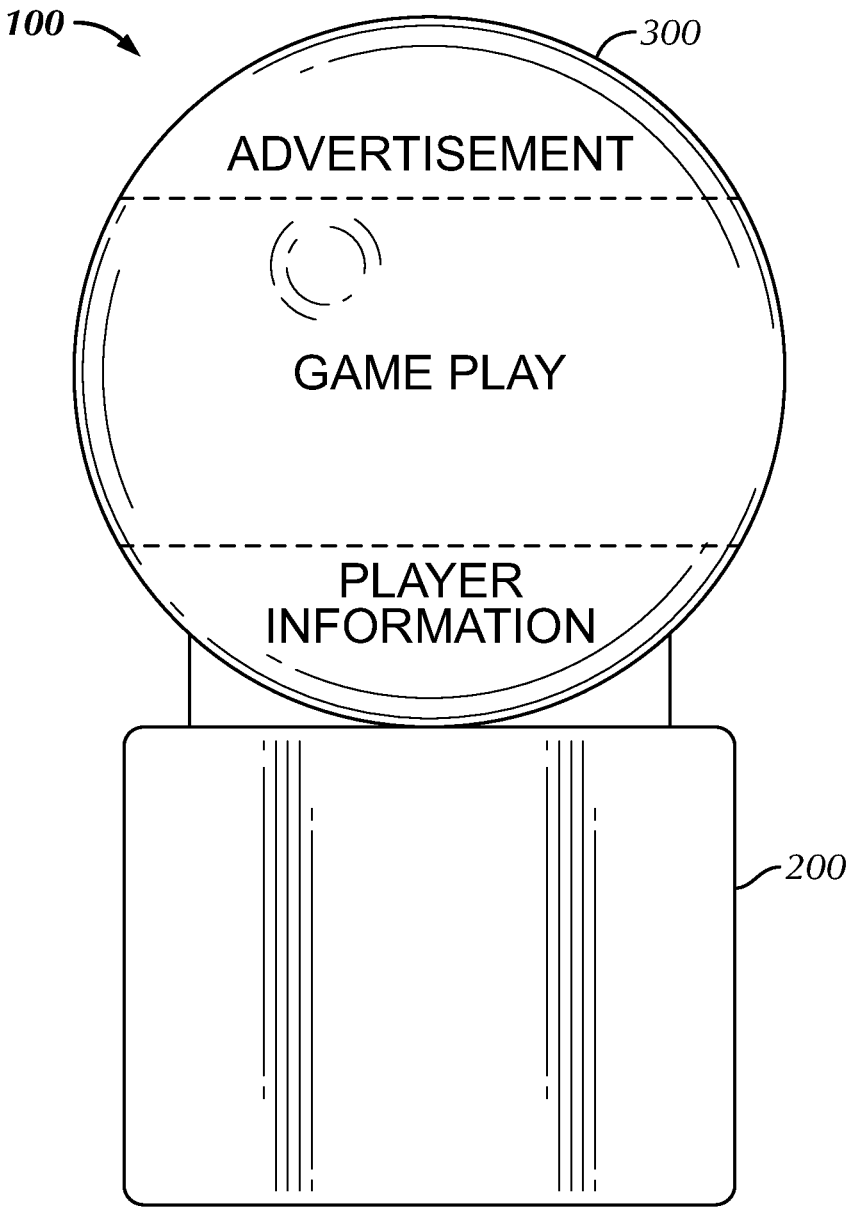
FIG. 10 is a front view of the electronic gaming machine having the housing and the shareable multi-sided display and input device of FIG. 1, and showing different vertically arrange portions of the shareable multi-sided display and input device being used to display different games, images, and information.

In various embodiments, the 360 degree device 300 enables a plurality of different portions of the 360 degree device 300 to be used for different purposes. For example, FIG. 10 shows an upper portion of the part of the 360 degree device 300 being used for an advertisement (which can be, for example, a casino advertisement or an attract mode), the central portion of the 360 degree device 300 being used for game play, and the bottom portion of the 360 degree device 300 being used for specific player information (such as but not limited to the player credit balance or meter display, the bet meter display, the win meter display, the player input buttons, the player tracking information, and/or a service window display).

In various embodiments, if less than the maximum quantity of players are playing the EGM 100, the 360 degree device 300 simultaneously displays: (1) game play to each player in a designated portion of the 360 degree device 300 (such as a single player using a 90 degree slice or viewable portion of the 360 degree device 300); and (2) an attract mode, other advertisements, or other images in the other portions that are generally non-viewable areas of the device for the that player (if the player does not move around the 360 degree display 300).

In various such embodiments, the EGM 100 and the 360 degree device 300 are configured to display enhanced attract mode displays and presentations. It should also be appreciated that if no players are playing the EGM 100, the EGM 100 can use the entire 360 degree device 300 to display further enhanced attract mode displays and presentations.

In various embodiments, the 360 degree device 300 enables each of the one or more players to use the 360 degree device 300 to make inputs related to game play by directly touching the 360 degree device 300 such as but not limited to: (1) wager inputs; (2) cash out inputs; (3) inputs corresponding to game elements selections (such as cards or bonus game selections); (4) inputs corresponding to selection of games or options of games; (5) inputs corresponding to player tracking points such as redeeming points for awards; (6) inputs corresponding to service window related functionality; (7) inputs related to or for placing sports bets; (8) inputs to move displayed elements; (9) inputs related to bonus events and other gestures to trigger events; (10) inputs related to positions of a character or bonus item; (11) inputs related to a spin of a reel, wheel, or other object; (12) inputs relating to the movement of a ball; (13) inputs related to a swipe and other gesture; (14) inputs related to a player tracking system, portal, and/or screen; and/or (15) inputs related to game help screens and other instructions.

In various embodiments, the 360 degree device 300 enables one or more of the players to see parts of one or more of the other players (such as the faces of the other players) through the 360 degree device 300. For example, the 360 degree device 300 may enable player 1 to see the face of player 2 (who is across from player 1 in FIG. 6) through the 360 degree device 300. In various such embodiments, this can be done through providing two or more transparent sections of the 360 degree device 300 that literally enable player 1 to look through the 360 degree device 300 to see player 2. In various other embodiments, the 360 degree device 300 can include one or more cameras that capture one or more images (such as videos) of the players from the inside of the 360 degree device 300 and display such images to the opposing players.

In various embodiments, the 360 degree device 300 enables each of the players to touch the 360 degree device 300 to make one or more touch inputs into the EGM 100. In various embodiments, this is provided using suitable touch screen technology. In various embodiments, this is provided using suitable camera sensing technology. This functionality can be provided in any other suitable manner.

In various embodiments, the 360 degree device 300 is configured to enable multiple players to make simultaneous touch inputs into the 360 degree device 300. The 360 degree device 300 is therefore particularly suited for enabling multiple player to simultaneously play skill games where players use their inputs to affect a team style games or a head to head style game (where players play against each other), or combinations thereof.

In various embodiments, the 360 degree device 300 can also be employed to determine a player biometric data such as a player's fingerprints. For example, the 360 degree device 300 can include one or more fingerprint sensors. In other examples, the 360 degree device 300 can include facial recognition systems for user identification.

In various embodiments, the EGM 100 is configured to detect and communicate with player mobile devices to provide one or more various functions for the players. These functions can include but are not limited to: (1) receiving player identification; (2) receiving player tracking information (such as associated with a player tracking system); (3) sending and receiving player funds (such as to and from an e-wallet system); (4) receiving player preference data; (5) receiving player game related data; (6) receiving or determining player location data; (7) receiving or determining mobile device signal strength data; (8) receiving or determining mobile device orientation data; (9) receiving mobile device inputs (such as touch, buttons, and/or face recognition, inputs); (10) receiving mobile device audio and/or visual data; and (11) receiving inputs from the mobile devices to modify content displayed by the 360 degree device 100.

In various embodiments, the EGM 100 is configured to detect an RFID on a player card such as a player tracking card.

In various embodiments, the EGM 100 and the 360 degree display device is configured enable one or more players to make input using stylus in addition to or alternatively with their fingers.

In the embodiments where the player can transfer funds to the EGM 100 using their mobile devices, the EGM 100 enables the player to initiate play on the EGM 100 though such process. In these embodiments and other embodiments, the EGM may alternatively be configured to receive funds and player initiation in other suitable manners. For example, the housing 200 may include one or more: (1) conventional bill or ticket acceptors and validators that are configured to receive currency or tickets from players in a conventional manner; and/or (2) one or more player tracking device receivers.

In various embodiments, the 360 degree device 300 and the EGM 100 can additionally or alternatively function as a kiosk. This would enable one or more multiple people to use the EGM 100 to convert money to tickets and tickets to money. In such embodiments, the 360 degree device 100 can appropriate different portions for different uses or different people. In various such embodiments the 360 degree device can enable people to use their mobile device to register transaction while in line to expedite the time at the kiosk.

In various embodiments, the 360 degree device 300 and the EGM 100 can enable multiple player to wagers on portions of the 360 degree display device such as other players portions.

In various embodiments, one or more other display devices may be employed with the EGM 100 and the 360 degree device 300. For example, an overhead display device (not shown) that displays a progressive meter display or leaderboard may be employed with the EGM 100 having the 360 degree display device 300.

In various embodiments, the EGM 100 and the 360 degree device 300 can include one or more handles for activating games. Such handles can include one or spherical or substantially spherical knobs.

In various embodiments, the EGM 100 and the 360 degree device 300 can include one or more spherical or substantially spherical or half spherical input devices.

In various embodiments, the EGM 100 can include multiple 360 degree devices such as stacked 360 degree devices that are vertically adjacent to one another.

In various embodiments, the EGM 100 and the 360 degree device can be configured to operate with one or more AG (Augmented Reality) mechanisms.

In various embodiments, the EGM 100 and the 360 degree device can be configured with 3D display devices to provide display of 3D images or to provide displays with actual or player perceived depth.

In various embodiments, the EGM 100 and the 360 degree device can be configured to operate to display layered levels (such as layered clouds).

In various embodiments, the EGM 100 and the 360 degree device can be configured to operate to display portal of environments (such as one or multiple worlds).

In various embodiments, the EGM 100 and the 360 degree device can be configured to operate display content exiting the 360 degree display (such as missiles, spacecraft, etc.).

Second Example Gaming System

Figure 11:
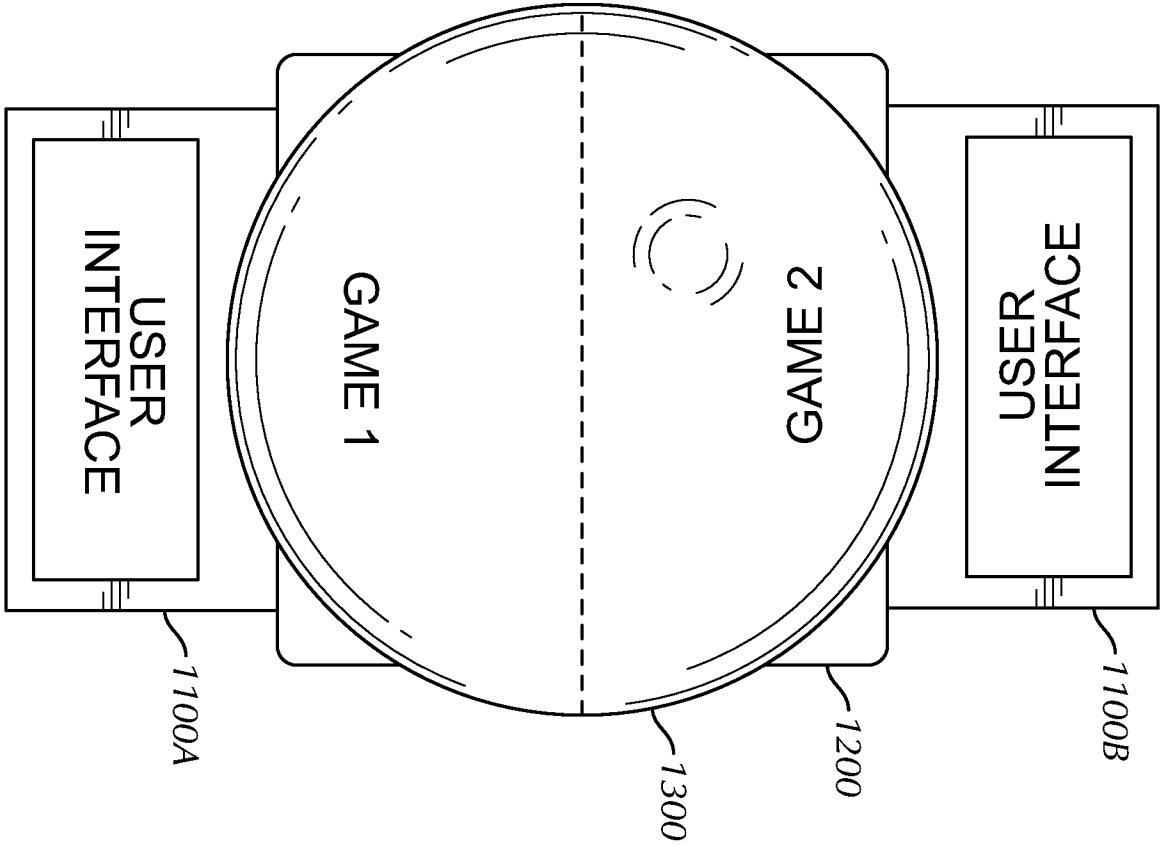
FIG. 11 is a top view of a gaming system having two electronic gaming machines and a shareable multi-sided display and input device of another example embodiment of the present disclosure.

Referring now to FIG. 11, another example gaming system of the present disclosure is generally illustrated. This example gaming system includes: (1) two EGMs 1100A and 1100B; (2) a central housing 1200; and (3) a shareable 360 degree device 1300 suitable mounted on, suitable connected to, and suitably supported by the housing 1200. The illustrated example 360 degree device 1300 enables two players to operate the respective EGMs 1100A and 11006 while standing adjacent to the respective EGMs 1100A and 1100B, or while sitting in player chairs (not shown) adjacent to the respective EGMs 1100A and 1100B. In this illustrated example embodiment, the EGMs 1100A and 11006 and the shareable 360 degree device 1300 is configured to perform any or all of the functions as described above. Additionally, the EGMs 1100A and 11006 include one or more conventional display devices (not labeled) and/or one or more conventional input devices (not labeled) for additional or alternative interaction with the players. In various such embodiments, the EGMs 1100A and 11006 are slant top type EGMs.

In various alternative embodiments, the 360 degree device 1300 does not includes any input devices or functionality and all of the inputs by the player are made using the input devices of the EGMs 1100A and 11006.

Third Example Gaming System

Figure 12:
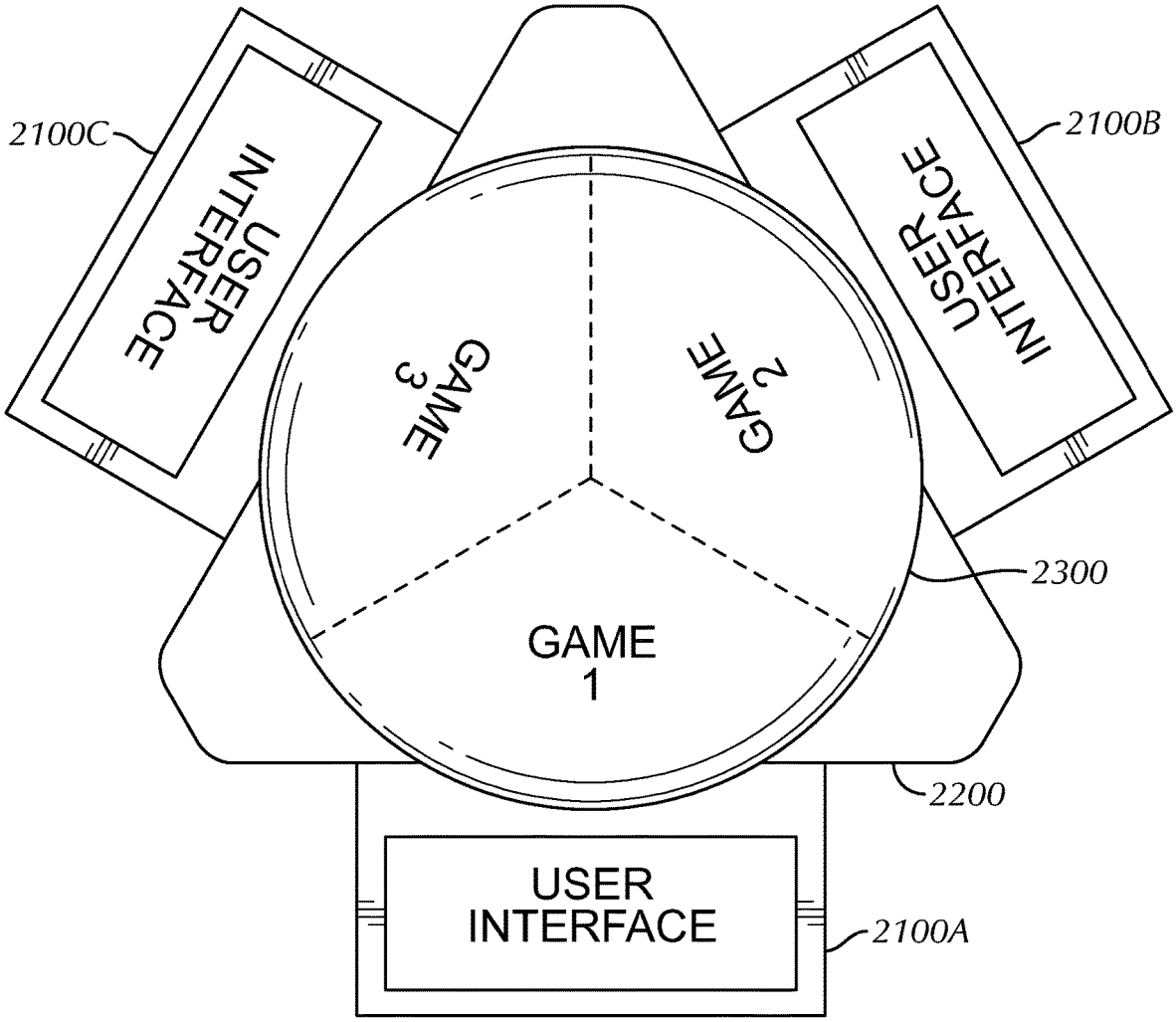
FIG. 12 is a top view of a gaming system having three electronic gaming machines and a shareable multi-sided display and input device of another example embodiment of the present disclosure.

Referring now to FIG. 12, another example gaming system of the present disclosure is generally illustrated. This example gaming system includes: (1) three EGMs 2100A, 2100B, and 2100C; (2) a central housing 2200; and (3) a shareable 360 degree device 2300 suitable mounted on, suitable connected to, and suitably supported by the housing 2200. The illustrated example 360 degree device 2300 enables three players to operate the respective EGMs 2100A, 2100B, and 2100C while standing adjacent to the respective EGMs 2100A, 2100B, and 2100C or while sitting in player chairs (not shown) adjacent to the respective EGMs 2100A, 2100B, and 2100C. In this illustrated example embodiment, the EGMs 2100A, 2100B, and 2100C and the shareable 360 degree device 3300 is configured to perform any or all of the functions as described above. Additionally, the EGMs 2100A, 2100B, and 2100C include one or more conventional display devices (not labeled) and/or one or more conventional input devices (not labeled) for additional or alternative interaction with the players. In various such embodiments, the EGMs 2100A, 2100B, and 2100C are slant top type EGMs.

In various alternative embodiments, the 360 degree device 2300 does not includes any input devices or functionality and all of the inputs by the player are made using the input devices of the EGMs 2100A, 2100B, and 2100C.

Fourth Example Gaming System

Figure 13:
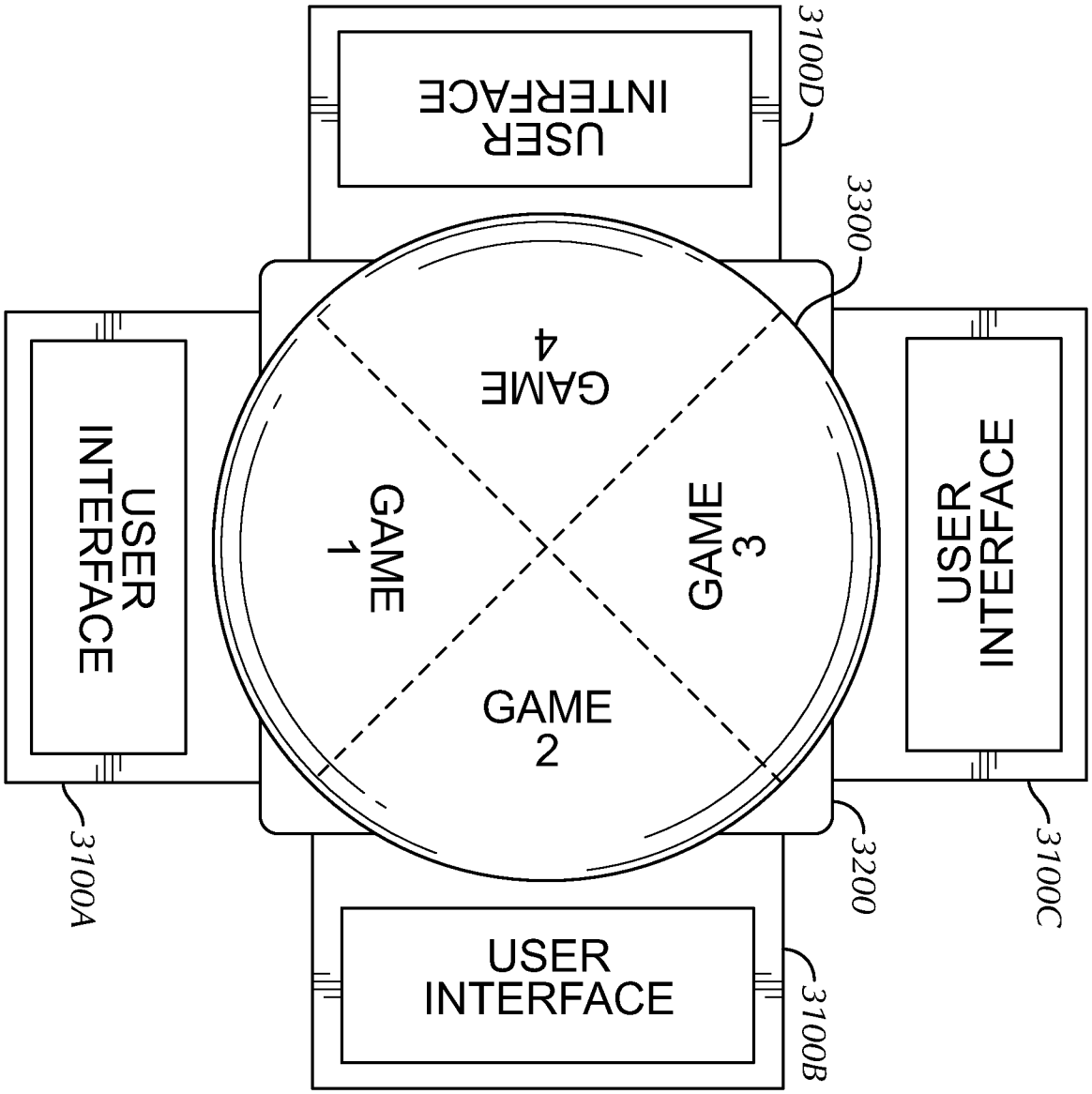
FIG. 13 is a top view of a gaming system having four electronic gaming machines and a shareable multi-sided display and input device of another example embodiment of the present disclosure.

Referring now to FIG. 13, another example gaming system of the present disclosure is generally illustrated. This example gaming system includes: (1) four EGMs 3100A, 3100B, 3100C and 3100D; (2) a central housing 3200; and (3) a shareable 360 degree device 3300 suitable mounted on, suitable connected to, and suitably supported by the housing 2200. The illustrated example 360 degree device 3300 enables four players to operate the respective EGMs 3100A, 3100B, 3100C and 3100D while standing adjacent to the respective EGMs 3100A, 3100B, 3100C and 3100D or while sitting in player chairs (not shown) adjacent to the respective EGMs 3100A, 3100B, 3100C and 3100D. In this illustrated example embodiment, the EGMs 3100A, 3100B, 3100C and 3100D and the shareable 360 degree device 3300 is configured to perform any or all of the functions as described above. Additionally, the EGMs 3100A, 3100B, 3100C and 3100D include one or more conventional display devices (not labeled) and/or one or more conventional input devices (not labeled) for additional or alternative interaction with the players. In various such embodiments, the EGMs 3100A, 3100B, 3100C and 3100D are slant top type EGMs.

In various alternative embodiments, the 360 degree device 3300 does not includes any input devices or functionality and all of the inputs by the player are made using the input devices of the EGMs 3100A, 31006, 3100C and 3100D.

It should be appreciated from the second, third, and fourth illustrated example embodiments that the quantity of EGMs associated with the 360 degree device may vary in accordance with the present disclosure.

It should also be appreciated that illustrated example embodiments that the size of the EGM(s) and the 360 degree device may vary in accordance with the present disclosure.

EGM—General Components and Operation

The EGM of the present disclosure can be controlled locally by one or more processors, and/or remotely or partially remotely by one or more remote processors, central servers, central controllers, or remote host. In various embodiments, the EGM of the present disclosure can be part of a gaming system (which is also part of the present disclosure) that includes one or more EGMs in combination with one or more remote processors, central servers, central controllers, or remote hosts. In such embodiments, the EGM is configured to communicate with the remote processors, central servers, central controllers, or remote hosts through a data network or remote communication link. In certain such embodiments, the EGM is configured to communicate with one or more other EGMs through the same data network or remote communication link or through a different data network or remote communication link.

In certain embodiments in which the gaming system includes an EGM in combination with a remote processor, central server, central controller, or remote host, the remote processor, central server, central controller, or remote host is any suitable computing device that includes at least one processor and at least one memory device or data storage device. As further described herein, the EGM includes at least one EGM processor configured to transmit and receive data or signals representing events, messages, commands, or any other suitable information between the EGM and the remote processor, central server, central controller, or remote host. The at least one processor of that EGM is configured to execute the events, messages, or commands represented by such data or signals in conjunction with the operation of the EGM. Moreover, the at least one processor of the remote processor, central server, central controller, or remote host is configured to transmit and receive data or signals representing events, messages, commands, or any other suitable information between the remote processor, central server, central controller, or remote host and the EGM. One, more than one, or each of the functions of the at least one processor of the EGM may be performed by the remote processor, the central server, the central controller, or the remote host.

In certain such embodiments, computerized instructions for controlling any games (such as any primary or base games and/or any secondary or bonus games) displayed by the EGM are executed by the remote processor, central server, central controller, or remote host. In such "thin client" embodiments, the remote processor, central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the remote processor, central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a remote processor, central server, central controller, or remote host, computerized instructions for controlling any primary or base games displayed by the EGM are communicated from the remote processor, central server, central controller, or remote host to the EGM in a thick client configuration, and computerized instructions for controlling any secondary or bonus games or other functions displayed by the EGM are executed by the remote processor, central server, central controller, or remote host in a thin client configuration.

In certain embodiments in which the gaming system includes: (a) an EGM configured to communicate with a remote processor, central server, central controller, or remote host through a data network; and/or (b) a plurality of EGMs configured to communicate with one another through a data network, the data network is a local area network (LAN) in which the EGMs are located substantially proximate to one another and/or the remote processor, central server, central controller, or remote host. In one example, the EGMs and the remote processor, central server, central controller, or remote host are located in a gaming establishment or a portion of a gaming establishment.

In other embodiments in which the gaming system includes: (a) an EGM configured to communicate with a remote processor, central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the remote processor, central server, central controller, or remote host. For example, one or more of the EGMs are located: (a) in an area of a gaming establishment different from an area of the gaming establishment in which the remote processor, central server, central controller, or remote host is located; or (b) in a gaming establishment different from the gaming establishment in which the remote processor, central server, central controller, or remote host is located. In another example, the remote processor, central server, central controller, or remote host is not located within a gaming establishment in which the EGMs are located. In certain embodiments in which the data network is a WAN, the gaming system includes a remote processor, central server, central controller, or remote host and an EGM each located in a different gaming establishment in a same geographic area, such as a same city or a same state. Gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a remote processor, central server, central controller, or remote host through a data network; and/or (b) a plurality of EGMs configured to communicate with one another through a data network, the data network is an internet (such as the Internet) or an intranet. In certain such embodiments, an Internet browser of the EGM is usable to access an Internet game page from any location where an Internet connection is available. In one such embodiment, after the EGM accesses the Internet game page, the remote processor, central server, central controller, or remote host identifies a player prior to enabling that player to place any wagers on any plays of any wagering games. In one example, the remote processor, central server, central controller, or remote host identifies the player by requiring a player account of the player to be logged into via an input of a unique username and password combination assigned to the player. The remote processor, central server, central controller, or remote host may, however, identify the player in any other suitable manner, such as: by validating a player tracking identification number associated with the player; by reading a player tracking card or other smart card inserted into a card reader (as described below); by validating a unique player identification number associated with the player by the remote processor, central server, central controller, or remote host; or by identifying the EGM, such as by identifying the MAC address or the IP address of the Internet facilitator. In various embodiments, once the remote processor, central server, central controller, or remote host identifies the player, the remote processor, central server, central controller, or remote host enables placement of one or more wagers on one or more plays of one or more primary or base games and/or one or more secondary or bonus games, and displays those plays via the Internet browser of the EGM. Examples of implementations of Internet-based gaming are further described in U.S. Pat. No. 8,764,566, entitled "Internet Remote Game Server," and U.S. Pat. No. 8,147,334, entitled "Universal Game Server."

The remote processor, central server, central controller, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile Internet network), or any other suitable medium. The expansion in the quantity of computing devices and the quantity and speed of Internet connections in recent years increases opportunities for players to use a variety of EGMs to play games from an ever-increasing quantity of remote sites. Additionally, the enhanced bandwidth of digital wireless communications may render such technology suitable for some or all communications, particularly if such communications are encrypted. Higher data transmission speeds may be useful for enhancing the sophistication and response of the display and interaction with players.

In various embodiments, the EGM includes a master gaming controller configured to communicate with and to operate with a plurality of peripheral devices (in addition to and including the 360 degree device 300, 1300, 2300, or 3300)).

The master gaming controller includes at least one processor. The at least one processor is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information or game information) via a communication interface of the master gaming controller; (2) converting signals read by an interface to a format corresponding to that used by software or memory of the EGM; (3) accessing memory to configure or reconfigure game parameters in the memory according to indicia read from the EGM; (4) communicating with interfaces and the peripheral devices (such as input/output devices); and/or (5) controlling the peripheral devices. In certain embodiments, one or more components of the master gaming controller (such as the at least one processor) reside within a housing of the EGM (described below), while in other embodiments at least one component of the master gaming controller resides outside of the housing of the EGM.

The master gaming controller also includes at least one memory device, which includes: (1) volatile memory (e.g., RAM, which can include non-volatile RAM, magnetic RAM, ferroelectric RAM, and any other suitable forms); (2) non-volatile memory (e.g., disk memory, FLASH memory, EPROMs, EEPROMs, memristor-based non-volatile solid-state memory, etc.); (3) unalterable memory (e.g., EPROM); (4) read-only memory; and/or (5) a secondary memory storage device, such as a non-volatile memory device, configured to store gaming software related information (the gaming software related information and the memory may be used to store various audio files and games not currently being used and invoked in a configuration or reconfiguration). Any other suitable magnetic, optical, and/or semiconductor memory may operate in conjunction with the EGM disclosed herein. In certain embodiments, the at least one memory device resides within the housing of the EGM (described below), while in other embodiments at least one component of the at least one memory device resides outside of the housing of the EGM.

The at least one memory device is configured to store, for example: (1) configuration software, such as all the parameters and settings for a game playable on the EGM; (2) associations between configuration indicia read from an EGM with one or more parameters and settings; (3) communication protocols configured to enable the at least one processor to communicate with the peripheral devices; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the EGM to communicate with local and non-local devices using such protocols. In one implementation, the master gaming controller communicates with other devices using a serial communication protocol. A few non-limiting examples of serial communication protocols that other devices, such as peripherals (e.g., a bill validator or a ticket printer), may use to communicate with the master game controller include USB, RS-232, and Netplex (a proprietary protocol developed by IGT).

In certain embodiments, the at least one memory device is configured to store program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an Internet or intranet).

The at least one memory device also stores a plurality of device drivers. Examples of different types of device drivers include device drivers for EGM components and device drivers for the peripheral components. Typically, the device drivers utilize various communication protocols that enable communication with a particular physical device. The device driver abstracts the hardware implementation of that device. For example, a device driver may be written for each type of card reader that could potentially be connected to the EGM. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the EGM loads the new device driver from the at least one memory device to enable communication with the new device. For instance, one type of card reader in the EGM can be replaced with a second different type of card reader when device drivers for both card readers are stored in the at least one memory device.

In certain embodiments, the software units stored in the at least one memory device can be upgraded as needed. For instance, when the at least one memory device is a hard drive, new games, new game options, new parameters, new settings for existing parameters, new settings for new parameters, new device drivers, and new communication protocols can be uploaded to the at least one memory device from the master game controller or from some other external device. As another example, when the at least one memory device includes a CD/DVD drive including a CD/DVD configured to store game options, parameters, and settings, the software stored in the at least one memory device can be upgraded by replacing a first CD/DVD with a second CD/DVD. In yet another example, when the at least one memory device uses flash memory or EPROM units configured to store games, game options, parameters, and settings, the software stored in the flash and/or EPROM memory units can be upgraded by replacing one or more memory units with new memory units that include the upgraded software. In another embodiment, one or more of the memory devices, such as the hard drive, may be employed in a game software download process from a remote software server.

In certain embodiments, the at least one memory device also stores authentication and/or validation components configured to authenticate/validate specified EGM components and/or information, such as hardware components, software components, firmware components, peripheral device components, user input device components, information received from one or more user input devices, information stored in the at least one memory device, etc. Examples of various authentication and/or validation components are described in U.S. Pat. No. 6,620,047, entitled "Electronic Gaming Apparatus Having Authentication Data Sets."

In certain embodiments, in addition to the input, output and other components described in the first section above, the peripheral devices include several device interfaces, such as: (1) at least one output device including at least one display device; (2) at least one input device (which may include contact and/or non-contact interfaces); (3) at least one transponder; (4) at least one wireless communication component; (5) at least one wired/wireless power distribution component; (6) at least one sensor; (7) at least one data preservation component; (8) at least one motion/gesture analysis and interpretation component; (9) at least one motion detection component; (10) at least one portable power source; (11) at least one geolocation module (12) at least one user identification module; (13) at least one player/device tracking module; and (14) at least one information filtering module.

The at least one output device includes at least one display device configured to display any game(s) displayed by the EGM and any suitable information associated with such game(s). In certain embodiments, the display devices are connected to or mounted on a housing of the EGM (described below). In various embodiments, the display devices serve as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, the at least one output device includes a payout device. In these embodiments, after the EGM receives an actuation of a cashout device (described below), the EGM causes the payout device to provide a payment to the player. In one embodiment, the payout device is one or more of: (a) a ticket printer and dispenser configured to print and dispense a ticket or credit slip associated with a monetary value, wherein the ticket or credit slip may be redeemed for its monetary value via a cashier, a kiosk, or other suitable redemption system; (b) a bill dispenser configured to dispense paper currency; (c) a coin dispenser configured to dispense coins or tokens (such as into a coin payout tray); and (d) any suitable combination thereof. Examples of ticket-in ticket-out (TITO) technology are described in U.S. Pat. No. 5,429,361, entitled "Gaming Machine Information, Communication and Display System"; U.S. Pat. No. 5,470,079, entitled "Gaming Machine Accounting and Monitoring System"; U.S. Pat. No. 5,265,874, entitled "Cashless Gaming Apparatus and Method"; U.S. Pat. No. 6,729,957, entitled "Gaming Method and Host Computer with Ticket-In/Ticket-Out Capability"; U.S. Pat. No. 6,729,958, entitled "Gaming System with Ticket-In/Ticket-Out Capability"; U.S. Pat. No. 6,736,725, entitled "Gaming Method and Host Computer with Ticket-In/Ticket- Out Capability"; U.S. Pat. No. 7,275,991, entitled "Slot Machine with Ticket-In/Ticket-Out Capability"; and U.S. Pat. No. 6,048,269, entitled "Coinless Slot Machine System and Method"."

In certain embodiments, rather than dispensing bills, coins, or a physical ticket having a monetary value to the player following receipt of an actuation of the cashout device, the payout device is configured to cause a payment to be provided to the player in the form of an electronic funds transfer, such as via a direct deposit into a bank account, a casino account, or a prepaid account of the player; via a transfer of funds onto an electronically recordable identification card or smart card of the player; or via sending a virtual ticket having a monetary value to an electronic device of the player. Examples of providing payment using virtual tickets are described in U.S. Pat. No. 8,613,659, entitled "Virtual Ticket-In and Ticket-Out on a Gaming Machine."

While any credit balances, any wagers, any values, and any awards are described herein as amounts of monetary credits or currency, one or more of such credit balances, such wagers, such values, and such awards may be for non-monetary credits, promotional credits, of player tracking points or credits.

In certain embodiments, the at least one output device includes one or more sound generating devices controlled by one or more sound cards. In one such embodiment, the sound generating device includes one or more speakers or other sound generating hardware and/or software configured to generate sounds, such as by playing music for any games or by playing music for other modes of the EGM, such as an attract mode. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

The at least one input device may include any suitable device that enables an input signal to be produced and received by the at least one processor of the EGM.

In one embodiment, the at least one input device includes a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof.

In one embodiment, the at least one input device includes a payment device configured to enable the EGM to be funded via an electronic funds transfer, such as a transfer of funds from a bank account. In another embodiment, the EGM includes a payment device configured to communicate with a mobile device of a player, such as a mobile phone, a radio frequency identification tag, or any other suitable wired or wireless device, to retrieve relevant information associated with that player to fund the EGM. Examples of funding an EGM via communication between the EGM and a mobile device (such as a mobile phone) of a player are described in U.S. Patent Application Publication No. 2013/0344942, entitled "Avatar as Security Measure for Mobile Device Use with Electronic Gaming Machine." When the EGM is funded, the at least one processor determines the amount of funds entered and displays the corresponding amount on a credit display or any other suitable display as described below.

In certain embodiments, the at least one input device includes at least one wagering or betting device. In various embodiments, the one or more wagering or betting devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). One such wagering or betting device is as a maximum wager or bet device that, when actuated, causes the EGM to place a maximum wager on a play of a game. Another such wagering or betting device is a repeat bet device that, when actuated, causes the EGM to place a wager that is equal to the previously-placed wager on a play of a game. A further such wagering or betting device is a bet one device that, when actuated, causes the EGM to increase the wager by one credit. Generally, upon actuation of one of the wagering or betting devices, the quantity of credits displayed in a credit meter (described below) decreases by the amount of credits wagered, while the quantity of credits displayed in a bet display (described below) increases by the amount of credits wagered.

In various embodiments, the at least one input device includes at least one game play activation device. In various embodiments, the one or more game play initiation devices are each: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). After a player appropriately funds the EGM and places a wager, the EGM activates the game play activation device to enable the player to actuate the game play activation device to initiate a play of a game on the EGM (or another suitable sequence of events associated with the EGM). After the EGM receives an actuation of the game play activation device, the EGM initiates the play of the game. In other embodiments, the EGM begins game play automatically upon appropriate funding rather than upon utilization of the game play activation device.

In other embodiments, the at least one input device includes a cashout device. In various embodiments, the cashout device is: (1) a mechanical button supported by the housing of the EGM (such as a hard key or a programmable soft key), or (2) an icon displayed on a display device of the EGM (described below) that is actuatable via a touch screen of the EGM (described below) or via use of a suitable input device of the EGM (such as a mouse or a joystick). When the EGM receives an actuation of the cashout device from a player and the player has a positive (i.e., greater-than-zero) credit balance, the EGM initiates a payout associated with the player's credit balance.

In various embodiments, the at least one input device includes a plurality of buttons that are programmable by the EGM operator to, when actuated, cause the EGM to perform particular functions. For instance, such buttons may be hard keys, programmable soft keys, or icons displayed on a display device of the EGM (described below) that are actuatable via a touch screen of the EGM (described below) or via use of a suitable input device of the EGM (such as a mouse or a joystick).

In certain embodiments, the at least one input device includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In embodiments including a player tracking system, as further described below, the at least one input device includes a card reader in communication with the at least one processor of the EGM. The card reader is configured to read a player identification card inserted into the card reader.

The at least one wireless communication component includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component transmits electrical, electromagnetic, or optical signals that carry digital data streams or analog signals representing various types of information.

The at least one wired/wireless power distribution component includes components or devices that are configured to provide power to other devices. For example, in one embodiment, the at least one power distribution component includes a magnetic induction system that is configured to provide wireless power to one or more user input devices near the EGM. In one embodiment, a user input device docking region is provided, and includes a power distribution component that is configured to recharge a user input device without requiring metal-to-metal contact. In one embodiment, the at least one power distribution component is configured to distribute power to one or more internal components of the EGM, such as one or more rechargeable power sources (e.g., rechargeable batteries) located at the EGM.

In certain embodiments, in addition to the components described in the first section above, the at least one sensor includes at least one of: optical sensors, pressure sensors, RF sensors, infrared sensors, image sensors, thermal sensors, and biometric sensors. The at least one sensor may be used for a variety of functions, such as: detecting movements and/or gestures of various objects within a predetermined proximity to the EGM (in addition to the detections described above); detecting the presence and/or identity of various persons (e.g., players, casino employees, etc.), devices (e.g., user input devices), and/or systems within a predetermined proximity to the EGM.

The at least one data preservation component is configured to detect or sense one or more events and/or conditions that, for example, may result in damage to the EGM and/or that may result in loss of information associated with the EGM. Additionally, the data preservation system may be operable to initiate one or more appropriate action(s) in response to the detection of such events/conditions.

In addition to the player tracker described above, the EGM of the present disclosure can also include at least one motion/gesture analysis and interpretation component configured to analyze and/or interpret information relating to detected player movements and/or gestures to determine appropriate player input information relating to the detected player movements and/or gestures. For example, in one embodiment, the at least one motion/gesture analysis and interpretation component is configured to perform one or more of the following functions: analyze the detected gross motion or gestures of a player; interpret the player's motion or gestures (e.g., in the context of a casino game being played) to identify instructions or input from the player; utilize the interpreted instructions/input to advance the game state; etc. In other embodiments, at least a portion of these additional functions may be implemented at a remote system or device.

The at least one portable power source enables the EGM to operate in a mobile environment. For example, in one embodiment, the EGM includes one or more rechargeable batteries.

The at least one geolocation module is configured to acquire geolocation information from one or more remote sources and use the acquired geolocation information to determine information relating to a relative and/or absolute position of the EGM. For example, in one implementation, the at least one geolocation module is configured to receive GPS signal information for use in determining the position or location of the EGM. In another implementation, the at least one geolocation module is configured to receive multiple wireless signals from multiple remote devices (e.g., EGMs, servers, wireless access points, etc.) and use the signal information to compute position/location information relating to the position or location of the EGM.

The at least one user identification module is configured to determine the identity of the current user or current owner of the EGM. For example, in one embodiment, the current user is required to perform a login process at the EGM in order to access one or more features. Alternatively, the EGM is configured to automatically determine the identity of the current user based on one or more external signals, such as an RFID tag or badge worn by the current user and that provides a wireless signal to the EGM that is used to determine the identity of the current user. In at least one embodiment, various security features are incorporated into the EGM to prevent unauthorized users from accessing confidential or sensitive information.

The at least one information filtering module is configured to perform filtering (e.g., based on specified criteria) of selected information to be displayed at one or more displays of the EGM.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. U.S. Pat. No. 7,290,072 describes a variety of EGMs including one or more communication ports that enable the EGMs to communicate and operate with one or more external peripherals.

In certain embodiments, the EGM is a device that has obtained approval from a regulatory gaming commission, and in other embodiments, the EGM is a device that has not obtained approval from a regulatory gaming commission.

The EGMs described above are merely examples of different types of EGMs. Certain of these example EGMs may include one or more elements that may not be included in all gaming systems, and these example EGMs may not include one or more elements that are included in other gaming systems. For example, certain EGMs include a coin acceptor while others do not.

In various embodiments, an EGM may be implemented in one of a variety of different configurations. In various embodiments, the EGM may be implemented as one of: (a) a dedicated EGM in which computerized game programs executable by the EGM for controlling any primary or base games (sometimes referred to herein as "primary games") and/or any secondary or bonus games or other functions (sometimes referred to herein as "secondary games") displayed by the EGM are provided with the EGM prior to delivery to a gaming establishment or prior to being provided to a player; and (b) a changeable EGM in which computerized game programs executable by the EGM for controlling any primary games and/or secondary games displayed by the EGM are downloadable or otherwise transferred to the EGM through a data network or remote communication link; from a USB drive, flash memory card, or other suitable memory device; or in any other suitable manner after the EGM is physically located in a gaming establishment or after the EGM is provided to a player.

As generally explained above, in various embodiments in which the gaming system includes a remote processor, central server, central controller, or remote host and a changeable EGM, the at least one memory device of the remote processor, central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the remote processor, central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the EGM randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the EGM generates the game outcome(s) and/or the award(s) to be provided based on the associated probabilities. In these embodiments, since the EGM generates game outcomes and/or awards randomly or based on one or more probability calculations, there is no certainty that the EGM will ever provide any specific game outcome and/or award.

In certain embodiments, the EGM maintains one or more predetermined pools or sets of predetermined game outcomes and/or awards. In certain such embodiments, upon generation or receipt of a game outcome and/or award request, the EGM independently selects one of the predetermined game outcomes and/or awards from the one or more pools or sets. The EGM flags or marks the selected game outcome and/or award as used. Once a game outcome or an award is flagged as used, it is prevented from further selection from its respective pool or set; that is, the EGM does not select that game outcome or award upon another game outcome and/or award request. The EGM provides the selected game outcome and/or award. Examples of this type of award evaluation are described in U.S. Pat. No. 7,470,183, entitled "Finite Pool Gaming Method and Apparatus"; U.S. Pat. No. 7,563,163, entitled "Gaming Device Including Outcome Pools for Providing Game Outcomes"; U.S. Pat. No. 7,833,092, entitled "Method and System for Compensating for Player Choice in a Game of Chance"; U.S. Pat. No. 8,070,579, entitled "Bingo System with Downloadable Common Patterns"; and U.S. Pat. No. 8,398,472, entitled "Central Determination Poker Game."

In certain embodiments, the EGM determines a predetermined game outcome and/or award based on the results of a bingo, keno, or lottery game. In certain such embodiments, the EGM utilizes one or more bingo, keno, or lottery games to determine the predetermined game outcome and/or award provided for a primary game and/or a secondary game. The EGM is provided or associated with a bingo card. Each bingo card consists of a matrix or array of elements, wherein each element is designated with separate indicia. After a bingo card is provided, the EGM randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. Examples of this type of award determination are described in U.S. Pat.

No. 7,753,774, entitled "Using Multiple Bingo Cards to Represent Multiple Slot Paylines and Other Class III Game Options"; U.S. Pat. No. 7,731,581, entitled "Multi-Player Bingo Game with Multiple Alternative Outcome Displays"; U.S. Pat. No. 7,955,170, entitled "Providing Non-Bingo Outcomes for a Bingo Game"; U.S. Pat. No. 8,070,579, entitled "Bingo System with Downloadable Common Patterns"; and U.S. Pat. No. 8,500,538, entitled "Bingo Gaming System and Method for Providing Multiple Outcomes from Single Bingo Pattern."

In certain embodiments in which the EGM is configured to communicate with the remote processor, central server, central controller, or remote host for monitoring purposes only. In such embodiments, the EGM determines the game outcome(s) and/or award(s) to be provided in any of the manners described above, and the remote processor, central server, central controller, or remote host monitors the activities and events occurring on the EGM. In one such embodiment, the EGM includes a real-time or online accounting and gaming information system configured to communicate with the central server, central controller, or remote host. In this embodiment, the accounting and gaming information system includes: (a) a player database configured to store player profiles, (b) a player tracking module configured to track players (as described below), and (c) a credit system configured to provide automated transactions. Examples of such accounting systems are described in U.S. Pat. No. 6,913,534, entitled "Gaming Machine Having a Lottery Game and Capability for Integration with Gaming Device Accounting System and Player Tracking System," and U.S. Pat. No. 8,597,116, entitled "Virtual Player Tracking and Related Services."

As noted above, in various embodiments, the EGM includes one or more executable game programs executable by at least one processor of the EGM to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the EGM includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the EGM. In certain such embodiments, the EGM includes one or more paylines associated with the reels. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display areas on a requisite number of adjacent reels. In one such embodiment, one or more paylines are formed between at least two symbol display areas that are adjacent to each other by either sharing a common side or sharing a common corner (i.e., such paylines are connected paylines). The EGM enables a wager to be placed on one or more of such paylines to activate such paylines. In other embodiments in which one or more paylines are formed between at least two adjacent symbol display areas, the EGM enables a wager to be placed on a plurality of symbol display areas, which activates those symbol display areas.

In various embodiments, the EGM provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the EGM employs a ways to win award determination. In these embodiments, any outcome to be provided is determined based on a number of associated symbols that are generated in active symbol display areas on the requisite number of adjacent reels (i.e., not on paylines passing through any displayed winning symbol combinations). If a winning symbol combination is generated on the reels, one award for that occurrence of the generated winning symbol combination is provided. Examples of ways to win award determinations are described in U.S. Pat. No. 8,012,011, entitled "Gaming Device and Method Having Independent Reels and Multiple Ways of Winning"; U.S. Pat. No. 8,241,104, entitled "Gaming Device and Method Having Designated Rules for Determining Ways To Win"; and U.S. Pat. No. 8,430,739, entitled "Gaming System and Method Having Wager Dependent Different Symbol Evaluations."

In various embodiments, the EGM includes a progressive award. Typically, a progressive award includes an initial amount and an additional amount funded through a portion of each wager placed to initiate a play of a primary game. When one or more triggering events occurs, the EGM provides at least a portion of the progressive award. After the EGM provides the progressive award, an amount of the progressive award is reset to the initial amount and a portion of each subsequent wager is allocated to the next progressive award. Examples of progressive gaming systems or EGMs are described in U.S. Pat. No. 7,585,223, entitled "Server Based Gaming System Having Multiple Progressive Awards"; U.S. Pat. No. 7,651,392, entitled "Gaming Device System Having Partial Progressive Payout"; U.S. Pat. No. 7,666,093, entitled "Gaming Method and Device Involving Progressive Wagers"; U.S. Pat. No. 7,780,523, entitled "Server Based Gaming System Having Multiple Progressive Awards"; and U.S. Pat. No. 8,337,298, entitled "Gaming Device Having Multiple Different Types of Progressive Awards."

As generally noted above, in addition to providing winning credits or other awards for one or more plays of the primary game(s), in various embodiments the EGM provides credits or other awards for one or more plays of one or more secondary games. The secondary game typically enables an award to be obtained addition to any award obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). The secondary game(s) may be any type of suitable game, either similar to or completely different from the primary game.

In various embodiments, the EGM automatically provides or initiates the secondary game upon the occurrence of a triggering event or the satisfaction of a qualifying condition. In other embodiments, the EGM initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. Any suitable triggering event or qualifying condition or any suitable combination of a plurality of different triggering events or qualifying conditions may be employed.

In other embodiments, at least one processor of the EGM randomly determines when to provide one or more plays of one or more secondary games. In one such embodiment, no apparent reason is provided for providing the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the EGM determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. Examples of group gaming systems are described in U.S. Pat. No. 8,070,583, entitled "Server Based Gaming System and Method for Selectively Providing One or More Different Tournaments"; U.S. Pat. No. 8,500,548, entitled "Gaming System and Method for Providing Team Progressive Awards"; and U.S. Pat. No. 8,562,423, entitled "Method and Apparatus for Rewarding Multiple Game Players for a Single Win."

In various embodiments, the gaming system or EGM includes one or more player tracking systems. Such player tracking systems enable operators of the gaming system or EGM (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the EGM to begin a gaming session, the card reader reads the player identification number off the player tracking card to identify the player. The EGM timely tracks any suitable information or data relating to the identified player's gaming session. The EGM also timely tracks when the player tracking card is removed to conclude play for that gaming session. In another embodiment, rather than requiring insertion of a player tracking card into the card reader, the EGM utilizes one or more portable devices, such as a mobile phone, a radio frequency identification tag, or any other suitable wireless device, to track when a gaming session begins and ends. In another embodiment, the EGM utilizes any suitable biometric technology or ticket technology to track when a gaming session begins and ends.

In such embodiments, during one or more gaming sessions, the EGM tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the first display device and/or the upper display device. Examples of player tracking systems are described in U.S. Pat. No. 6,722,985, entitled "Universal Player Tracking System"; U.S. Pat. No. 6,908,387, entitled "Player Tracking Communication Mechanisms in a Gaming Machine"; U.S. Pat. No. 7,311,605, entitled "Player Tracking Assembly for Complete Patron Tracking for Both Gaming and Non-Gaming Casino Activity"; U.S. Pat. No. 7,611,411, entitled "Player Tracking Instruments Having Multiple Communication Modes"; U.S. Pat. No.

7,617,151, entitled "Alternative Player Tracking Techniques"; and U.S. Pat. No. 8,057,298, entitled "Virtual Player Tracking and Related Services."

Certain of the gaming systems described herein, including EGMs located in a casino or another gaming establishment, include certain components and/or are configured to operate in certain manners that differentiate these EGMs and systems from general purpose computing devices (i.e., certain personal gaming devices such as desktop computers and laptop computers).

For instance, EGMs are highly regulated to ensure fairness and, in many cases, EGMs are configured to award monetary awards up to multiple millions of dollars. To satisfy security and regulatory requirements in a gaming environment, hardware and/or software architectures are implemented in EGMs that differ significantly from those of general purpose computing devices. For purposes of illustration, a description of EGMs relative to general purpose computing devices and some examples of these additional (or different) hardware and/or software architectures found in EGMs are described below.

At first glance, one might think that adapting general purpose computing device technologies to the gaming industry and EGMs would be a simple proposition because both general purpose computing devices and EGMs employ processors that control a variety of devices. However, due to at least: (1) the regulatory requirements placed on EGMs, (2) the harsh environment in which EGMs operate, (3) security requirements, and (4) fault tolerance requirements, adapting general purpose computing device technologies to EGMs can be quite difficult. Further, techniques and methods for solving a problem in the general purpose computing device industry, such as device compatibility and connectivity issues, might not be adequate in the gaming industry. For instance, a fault or a weakness tolerated in a general purpose computing device, such as security holes in software or frequent crashes, is not tolerated in an EGM because in an EGM these faults can lead to a direct loss of funds from the EGM, such as stolen cash or loss of revenue when the EGM is not operating properly or when the random outcome determination is manipulated.

Certain differences between general purpose computing devices and EGMs are described below. A first difference between EGMs and general purpose computing devices is that EGMs are state-based systems. A state-based system stores and maintains its current state in a non-volatile memory such that, in the event of a power failure or other malfunction, the state-based system can return to that state when the power is restored or the malfunction is remedied. For instance, for a state-based EGM, if the EGM displays an award for a game of chance but the power to the EGM fails before the EGM provides the award to the player, the EGM stores the pre-power failure state in a non-volatile memory, returns to that state upon restoration of power, and provides the award to the player. This requirement affects the software and hardware design on EGMs. General purpose computing devices are typically not state-based machines, and a majority of data can be lost when a malfunction occurs on a general purpose computing device.

A second difference between EGMs and general purpose computing devices is that, for regulatory purposes, the software on the EGM utilized to operate the EGM has been designed to be static and monolithic to prevent cheating by the operator of the EGM. For instance, one solution that has been employed in the gaming industry to prevent cheating and to satisfy regulatory requirements has been to manufacture an EGM that can use a proprietary processor running instructions to provide the game of chance from an EPROM or other form of non-volatile memory. The coding instructions on the EPROM are static (non-changeable) and must be approved by a gaming regulators in a particular jurisdiction and installed in the presence of a person representing the gaming jurisdiction. Any changes to any part of the software required to generate the game of chance, such as adding a new device driver used to operate a device during generation of the game of chance, can require burning a new EPROM approved by the gaming jurisdiction and reinstalling the new EPROM on the EGM in the presence of a gaming regulator. Regardless of whether the EPROM solution is used, to gain approval in most gaming jurisdictions, an EGM must demonstrate sufficient safeguards that prevent an operator or a player of an EGM from manipulating the EGM's hardware and software in a manner that gives him an unfair, and in some cases illegal, advantage.

A third difference between EGMs and general purpose computing devices is authentication—EGMs storing code are configured to authenticate the code to determine if the code is unaltered before executing the code. If the code has been altered, the EGM prevents the code from being executed. The code authentication requirements in the gaming industry affect both hardware and software designs on EGMs. Certain EGMs use hash functions to authenticate code. For instance, one EGM stores game program code, a hash function, and an authentication hash (which may be encrypted). Before executing the game program code, the EGM hashes the game program code using the hash function to obtain a result hash and compares the result hash to the authentication hash. If the result hash matches the authentication hash, the EGM determines that the game program code is valid and executes the game program code. If the result hash does not match the authentication hash, the EGM determines that the game program code has been altered (i.e., may have been tampered with) and prevents execution of the game program code. Examples of EGM code authentication are described in U.S. Pat. No. 6,962,530, entitled "Authentication in a Secure Computerized Gaming System"; U.S. Pat. No. 7,043,641, entitled "Encryption in a Secure Computerized Gaming System"; U.S. Pat. No. 7,201,662, entitled "Method and Apparatus for Software Authentication"; and U.S. Pat. No. 8,627,097, entitled "System and Method Enabling Parallel Processing of Hash Functions Using Authentication Checkpoint Hashes."

A fourth difference between EGMs and general purpose computing devices is that EGMs have unique peripheral device requirements that differ from those of a general purpose computing device, such as peripheral device security requirements not usually addressed by general purpose computing devices. For instance, monetary devices, such as coin dispensers, bill validators, and ticket printers and computing devices that are used to govern the input and output of cash or other items having monetary value (such as tickets) to and from an EGM have security requirements that are not typically addressed in general purpose computing devices. Therefore, many general purpose computing device techniques and methods developed to facilitate device connectivity and device compatibility do not address the emphasis placed on security in the gaming industry.

To address some of the issues described above, a number of hardware/software components and architectures are utilized in EGMs that are not typically found in general purpose computing devices. These hardware/software components and architectures, as described below in more detail, include but are not limited to watchdog timers, voltage monitoring systems, state-based software architecture and supporting hardware, specialized communication interfaces, security monitoring, and trusted memory.

Certain EGMs use a watchdog timer to provide a software failure detection mechanism. In a normally-operating EGM, the operating software periodically accesses control registers in the watchdog timer subsystem to "re-trigger" the watchdog. Should the operating software fail to access the control registers within a preset timeframe, the watchdog timer will timeout and generate a system reset. Typical watchdog timer circuits include a loadable timeout counter register to enable the operating software to set the timeout interval within a certain range of time. A differentiating feature of some circuits is that the operating software cannot completely disable the function of the watchdog timer. In other words, the watchdog timer always functions from the time power is applied to the board.

Certain EGMs use several power supply voltages to operate portions of the computer circuitry. These can be generated in a central power supply or locally on the computer board. If any of these voltages falls out of the tolerance limits of the circuitry they power, unpredictable operation of the EGM may result. Though most modern general purpose computing devices include voltage monitoring circuitry, these types of circuits only report voltage status to the operating software. Out of tolerance voltages can cause software malfunction, creating a potential uncontrolled condition in the general purpose computing device. Certain EGMs have power supplies with relatively tighter voltage margins than that required by the operating circuitry. In addition, the voltage monitoring circuitry implemented in certain EGMs typically has two thresholds of control. The first threshold generates a software event that can be detected by the operating software and an error condition then generated. This threshold is triggered when a power supply voltage falls out of the tolerance range of the power supply, but is still within the operating range of the circuitry. The second threshold is set when a power supply voltage falls out of the operating tolerance of the circuitry. In this case, the circuitry generates a reset, halting operation of the EGM.

As described above, certain EGMs are state-based machines. Different functions of the game provided by the EGM (e.g., bet, play, result, points in the graphical presentation, etc.) may be defined as a state. When the EGM moves a game from one state to another, the EGM stores critical data regarding the game software in a custom non-volatile memory subsystem. This ensures that the player's wager and credits are preserved and to minimize potential disputes in the event of a malfunction on the EGM. In general, the EGM does not advance from a first state to a second state until critical information that enables the first state to be reconstructed has been stored. This feature enables the EGM to recover operation to the current state of play in the event of a malfunction, loss of power, etc. that occurred just prior to the malfunction. In at least one embodiment, the EGM is configured to store such critical information using atomic transactions.

Generally, an atomic operation in computer science refers to a set of operations that can be combined so that they appear to the rest of the system to be a single operation with only two possible outcomes: success or failure. As related to data storage, an atomic transaction may be characterized as series of database operations which either all occur, or all do not occur. A guarantee of atomicity prevents updates to the database occurring only partially, which can result in data corruption.

To ensure the success of atomic transactions relating to critical information to be stored in the EGM memory before a failure event (e.g., malfunction, loss of power, etc.), memory that includes one or more of the following criteria be used: direct memory access capability; data read/write capability which meets or exceeds minimum read/write access characteristics (such as at least 5.08 Mbytes/sec (Read) and/or at least 38.0 Mbytes/sec (Write)). Memory devices that meet or exceed the above criteria may be referred to as "fault-tolerant" memory devices.

Typically, battery-backed RAM devices may be configured to function as fault-tolerant devices according to the above criteria, whereas flash RAM and/or disk drive memory are typically not configurable to function as fault-tolerant devices according to the above criteria. Accordingly, battery-backed RAM devices are typically used to preserve EGM critical data, although other types of non-volatile memory devices may be employed. These memory devices are typically not used in typical general purpose computing devices.

Thus, in at least one embodiment, the EGM is configured to store critical information in fault-tolerant memory (e.g., battery-backed RAM devices) using atomic transactions. Further, in at least one embodiment, the fault-tolerant memory is able to successfully complete all desired atomic transactions (e.g., relating to the storage of EGM critical information) within a time period of 200 milliseconds or less. In at least one embodiment, the time period of 200 milliseconds represents a maximum amount of time for which sufficient power may be available to the various EGM components after a power outage event has occurred at the EGM.

As described previously, the EGM may not advance from a first state to a second state until critical information that enables the first state to be reconstructed has been atomically stored. After the state of the EGM is restored during the play of a game of chance, game play may resume and the game may be completed in a manner that is no different than if the malfunction had not occurred. Thus, for example, when a malfunction occurs during a game of chance, the EGM may be restored to a state in the game of chance just prior to when the malfunction occurred. The restored state may include metering information and graphical information that was displayed on the EGM in the state prior to the malfunction. For example, when the malfunction occurs during the play of a card game after the cards have been dealt, the EGM may be restored with the cards that were previously displayed as part of the card game. As another example, a bonus game may be triggered during the play of a game of chance in which a player is required to make a number of selections on a video display screen. When a malfunction has occurred after the player has made one or more selections, the EGM may be restored to a state that shows the graphical presentation just prior to the malfunction including an indication of selections that have already been made by the player. In general, the EGM may be restored to any state in a plurality of states that occur in the game of chance that occurs while the game of chance is played or to states that occur between the play of a game of chance.

Game history information regarding previous games played such as an amount wagered, the outcome of the game, and the like may also be stored in a non-volatile memory device. The information stored in the non-volatile memory may be detailed enough to reconstruct a portion of the graphical presentation that was previously presented on the EGM and the state of the EGM (e.g., credits) at the time the game of chance was played. The game history information may be utilized in the event of a dispute. For example, a player may decide that in a previous game of chance that they did not receive credit for an award that they believed they won. The game history information may be used to reconstruct the state of the EGM prior to, during, and/or after the disputed game to demonstrate whether the player was correct or not in her assertion. Examples of a state-based EGM, recovery from malfunctions, and game history are described in U.S. Pat. No. 6,804,763, entitled "High Performance Battery Backed RAM Interface"; U.S. Pat. No. 6,863,608, entitled "Frame Capture of Actual Game Play"; U.S. Pat. No. 7,111,141, entitled "Dynamic NV-RAM"; and U.S. Pat. No. 7,384,339, entitled, "Frame Capture of Actual Game Play."

Another feature of EGMs is that they often include unique interfaces, including serial interfaces, to connect to specific subsystems internal and external to the EGM. The serial devices may have electrical interface requirements that differ from the "standard" EIA serial interfaces provided by general purpose computing devices. These interfaces may include, for example, Fiber Optic Serial, optically coupled serial interfaces, current loop style serial interfaces, etc. In addition, to conserve serial interfaces internally in the EGM, serial devices may be connected in a shared, daisy-chain fashion in which multiple peripheral devices are connected to a single serial channel.

The serial interfaces may be used to transmit information using communication protocols that are unique to the gaming industry. For example, IGT's Netplex is a proprietary communication protocol used for serial communication between EGMs. As another example, SAS is a communication protocol used to transmit information, such as metering information, from an EGM to a remote device. Often SAS is used in conjunction with a player tracking system.

Certain EGMs may alternatively be treated as peripheral devices to a casino communication controller and connected in a shared daisy chain fashion to a single serial interface. In both cases, the peripheral devices are assigned device addresses. If so, the serial controller circuitry must implement a method to generate or detect unique device addresses. General purpose computing device serial ports are not able to do this.

Security monitoring circuits detect intrusion into an EGM by monitoring security switches attached to access doors in the EGM cabinet. Access violations result in suspension of game play and can trigger additional security operations to preserve the current state of game play. These circuits also function when power is off by use of a battery backup. In power-off operation, these circuits continue to monitor the access doors of the EGM. When power is restored, the EGM can determine whether any security violations occurred while power was off, e.g., via software for reading status registers. This can trigger event log entries and further data authentication operations by the EGM software.

Trusted memory devices and/or trusted memory sources are included in an EGM to ensure the authenticity of the software that may be stored on less secure memory subsystems, such as mass storage devices. Trusted memory devices and controlling circuitry are typically designed to not enable modification of the code and data stored in the memory device while the memory device is installed in the EGM. The code and data stored in these devices may include authentication algorithms, random number generators, authentication keys, operating system kernels, etc. The purpose of these trusted memory devices is to provide gaming regulatory authorities a root trusted authority within the computing environment of the EGM that can be tracked and verified as original. This may be accomplished via removal of the trusted memory device from the EGM computer and verification of the secure memory device contents is a separate third party verification device. Once the trusted memory device is verified as authentic, and based on the approval of the verification algorithms included in the trusted device, the EGM is enabled to verify the authenticity of additional code and data that may be located in the gaming computer assembly, such as code and data stored on hard disk drives. Examples of trusted memory devices are described in U.S. Pat. No. 6,685,567, entitled "Process Verification."

In at least one embodiment, at least a portion of the trusted memory devices/sources may correspond to memory that cannot easily be altered (e.g., "unalterable memory") such as EPROMS, PROMS, Bios, Extended Bios, and/or other memory sources that are able to be configured, verified, and/or authenticated (e.g., for authenticity) in a secure and controlled manner.

According to one embodiment, when a trusted information source is in communication with a remote device via a network, the remote device may employ a verification scheme to verify the identity of the trusted information source. For example, the trusted information source and the remote device may exchange information using public and private encryption keys to verify each other's identities. In another embodiment, the remote device and the trusted information source may engage in methods using zero knowledge proofs to authenticate each of their respective identities.

EGMs storing trusted information may utilize apparatuses or methods to detect and prevent tampering. For instance, trusted information stored in a trusted memory device may be encrypted to prevent its misuse. In addition, the trusted memory device may be secured behind a locked door. Further, one or more sensors may be coupled to the memory device to detect tampering with the memory device and provide some record of the tampering. In yet another example, the memory device storing trusted information might be designed to detect tampering attempts and clear or erase itself when an attempt at tampering has been detected. Examples of trusted memory devices/sources are described in U.S. Pat. No. 7,515,718, entitled "Secured Virtual Network in a Gaming Environment."

Mass storage devices used in a general purpose computing devices typically enable code and data to be read from and written to the mass storage device. In a gaming environment, modification of the gaming code stored on a mass storage device is strictly controlled and would only be enabled under specific maintenance type events with electronic and physical enablers required. Though this level of security could be provided by software, EGMs that include mass storage devices include hardware level mass storage data protection circuitry that operates at the circuit level to monitor attempts to modify data on the mass storage device and will generate both software and hardware error triggers should a data modification be attempted without the proper electronic and physical enablers being present. Examples of using a mass storage device are described in U.S. Pat. No. 6,149,522, entitled "Method of Authenticating Game Data Sets in an Electronic Casino Gaming System."

It should further be appreciated that the EGM of the present disclosure may have varying or alternative housing configurations.

Various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. An electronic gaming machine comprising:

a housing;

a substantially spherical display and input device supported by the housing;

a processor; and a memory device that stores a plurality of instructions, which when executed by the processor, cause the processor to:

receive, via the substantially spherical display and input device, an input from each of a plurality of players, and for each of the plurality of players, allocate a portion of the substantially spherical display and input device to display game play to the player, wherein a size of each portion is based on a quantity of the players, wherein for at least two different quantities of players, the sizes of the respective portions are different.

2. The electronic gaming machine of claim 1, wherein the plurality of instructions, when executed by the processor, cause the processor to receive, via the substantially spherical display and input device, an input to join game play from an additional player, and to allocate a portion of the substantially spherical display and input device to the additional player.

3. The electronic gaming machine of claim 2, wherein responsive to receiving the input from the additional player to join game play, the plurality of instructions, when executed by the processor, cause the processor to operate with the substantially spherical display and input device to reallocate one of the portions of the substantially spherical display and input device used to display the game play to one of the plurality of players.

4. The electronic gaming machine of claim 2, wherein responsive to receiving the input from the additional player to join game play, the plurality of instructions, when executed by the processor, cause the processor to operate with the substantially spherical display and input device to reallocate each of the portions of the substantially spherical display and input device used to display the game play to the plurality of players.

5. The electronic gaming machine of claim 1, wherein the game play for two of the players is of a shared game.

6. The electronic gaming machine of claim 1, wherein the game play for two of the players is of separate games.

7. The electronic gaming machine of claim 1, wherein the game play for two of the player is of a shared game and simultaneously wherein the game play for two of the players is of separate games.

8. The electronic gaming machine of claim 1, wherein the substantially spherical display device and input device is configured to enable one of the players to make an input using a mobile device.

9. An electronic gaming machine comprising:

a housing;

a substantially spherical display and input device supported by the housing;

a processor; and a memory device that stores a plurality of instructions, which when executed by the processor, cause the processor to:

receive, via the substantially spherical display and input device, an input from each of a plurality of players, for each of the plurality of players, allocate a portion of the substantially spherical display and input device to display game play to the player, allocate a portion of the substantially spherical display and input device for displaying images other than for the game play by the players, and operate with the substantially spherical display and input device to display a dame that requires the players to move around the substantially spherical display and input device.

10. The electronic gaming machine of claim 9, wherein the plurality of instructions, when executed by the processor, cause the processor to receive, via the substantially spherical display and input device, an input to join game play from an additional player, and to allocate a portion of the substantially spherical display and input device to the additional player without reallocating any of the portions for displaying images other than game play by the players.

11. The electronic gaming machine of claim 9, wherein the plurality of instructions, when executed by the processor, cause the processor to operate with the substantially spherical display and input device to display a video feed.

12. The electronic gaming machine of claim 9, wherein the substantially spherical display device and input device is configured to enable a player to make a wager-related input using a mobile device.

13. A gaming system comprising:

a substantially spherical display device; and a plurality of electronic gaming machines that share the substantially spherical display device;

the electronic gaming machines and the substantially spherical display device configured to:

for each of the plurality of electronic gaming machines, allocate a portion of the substantially spherical display device to display game play to a player of the that electronic gaming machine, wherein a size of each portion is based on a quantity of the electronic gaming machines being played, and simultaneously display separate games for two of the electronic gaming machines, separate player specific information, and non-game play related content.

14. The gaming system of claim 13, wherein the substantially spherical display device is centered above the plurality of electronic gaming machines.

15. The gaming system of claim 13, wherein the substantially spherical display device and the plurality of electronic gaming machines are configured to change the portions of the substantially spherical display device allocated to each electronic gaming machine.

16. The gaming system of claim 13, wherein the substantially spherical display device is configured to simultaneously display a shared game for two of the electronic gaming machines and non-game play related content.

17. The gaming system of claim 13, wherein the game play for two of the electronic gaming machines is of a shared game and simultaneously wherein the game play for two of the electronic gaming machines is of separate games.

* * * * *